US009372044B2

(12) United States Patent
Saunders

(10) Patent No.: US 9,372,044 B2
(45) Date of Patent: Jun. 21, 2016

(54) HANDLELESS SLINGSHOT WITH FOLDING STORAGE COMPARTMENT

(71) Applicant: Charles A. Saunders, Columbus, NE (US)

(72) Inventor: Charles A. Saunders, Columbus, NE (US)

(73) Assignee: Saunders Archery Company, Columbus, NE (US)

( * ) Notice: Subject to any disclaimer, the term of this patent is extended or adjusted under 35 U.S.C. 154(b) by 0 days.

(21) Appl. No.: 14/566,238

(22) Filed: Dec. 10, 2014

(65) Prior Publication Data

US 2015/0090238 A1 Apr. 2, 2015

Related U.S. Application Data

(63) Continuation of application No. 14/216,243, filed on Mar. 17, 2014, now Pat. No. 8,936,014.

(60) Provisional application No. 61/787,911, filed on Mar. 15, 2013.

(51) Int. Cl.
*F41B 3/02* (2006.01)

(52) U.S. Cl.
CPC ..... *F41B 3/02* (2013.01)

(58) Field of Classification Search
CPC ..... F41B 3/02; F41B 3/03
USPC ..... 124/16, 17, 20.1, 20.2, 41.1, 80
See application file for complete search history.

(56) References Cited

U.S. PATENT DOCUMENTS 1,487,973 A 3/1924 Preston
2,645,217 A * 7/1953 Fisher ..... F41B 3/02 124/16
2,661,731 A * 12/1953 Casey ..... F41B 3/02 124/20.2
2,672,857 A 3/1954 Gauthier
2,735,417 A * 2/1956 Denekar ..... F41B 3/02 124/20.1
2,995,129 A 8/1961 Malott
3,407,798 A 10/1968 Rock
3,511,221 A * 5/1970 Saunders ..... F41B 3/02 124/20.1
3,517,657 A * 6/1970 Alban ..... F41B 3/02 124/20.3
3,618,585 A 11/1971 Allison
3,901,209 A 8/1975 Woolsey et al.
3,974,820 A * 8/1976 Ott ..... F41B 3/02 124/20.1

(Continued)

OTHER PUBLICATIONS

Henrie, Roger "A Pair of Recurve Hunters Walnut and Hickory", on http://slingshotforum.com, post dated Feb. 13, 2013, p. 1-5.

(Continued)

*Primary Examiner* — Alexander Niconovich
(74) *Attorney, Agent, or Firm* — Levenfeld Pearlstein, LLC

(57) ABSTRACT

A handleless slingshot with a folding storage compartment is disclosed. The slingshot does not require that the user grip a handle to shoot it and the folding storage compartment may be removed or omitted if desired. The slingshot includes a storage compartment that can store projectiles (such as steel shot) and/or other supplies. The storage compartment is foldable such that it can be folded into the base of the slingshot to create a compact, portable unit. The slingshot includes a quick-release interchangeable band system that uses clips that matingly engage grooves formed at the ends of the slingshot arms to secure the band. The slingshot includes guard area which protects the web area of the hand when shooting the slingshot. The slingshot moves the thumb and index finger contact points forward of the band to increase stability and eliminate the need to grip a handle when shooting the slingshot.

9 Claims, 41 Drawing Sheets

(56) References Cited

U.S. PATENT DOCUMENTS

| | | | | | |
|---|---|---|---|---|---|
| 4,250,861 | A | | 2/1981 | Ellenburg | |
| 4,265,212 | A | | 5/1981 | Wolf | |
| 4,274,387 | A | | 6/1981 | McBride | |
| 4,307,699 | A | * | 12/1981 | Cuesta | F41B 3/02 124/22 |
| 4,373,503 | A | | 2/1983 | Saunders | |
| 4,437,449 | A | * | 3/1984 | Attanasio | F41B 3/02 124/22 |
| 4,569,324 | A | * | 2/1986 | Garcia | B21F 1/002 124/20.1 |
| 4,583,513 | A | | 4/1986 | Ellenburg et al. | |
| 4,771,756 | A | * | 9/1988 | Miles | F41B 3/02 124/20.1 |
| 4,877,007 | A | * | 10/1989 | Olson | F41B 3/02 124/20.3 |
| 5,230,323 | A | | 7/1993 | Saunders et al. | |
| 5,279,276 | A | * | 1/1994 | Nagel | F41B 3/02 124/20.1 |
| 5,345,922 | A | * | 9/1994 | Ott | F41B 3/02 124/16 |
| 5,501,207 | A | * | 3/1996 | Black | F41B 3/02 124/20.1 |
| 5,752,495 | A | * | 5/1998 | Tuller | F41B 3/02 124/20.2 |
| 6,786,213 | B1 | | 9/2004 | Lee | |
| 6,968,835 | B2 | | 11/2005 | Lee | |
| 7,389,774 | B1 | | 6/2008 | Fonda | |
| 7,484,505 | B1 | * | 2/2009 | Saunders | F41B 3/02 124/20.1 |
| 7,509,952 | B2 | | 3/2009 | Aiken et al. | |
| 7,543,579 | B2 | | 6/2009 | Chang | |
| 7,748,369 | B2 | | 7/2010 | Chee | |
| 7,823,571 | B2 | | 11/2010 | Williamson | |
| 7,827,977 | B2 | * | 11/2010 | Saunders | F41B 3/02 124/20.1 |
| 8,025,047 | B2 | * | 9/2011 | Saunders | F41B 3/02 124/20.1 |
| 8,347,868 | B2 | * | 1/2013 | Saunders | F41B 3/02 124/20.1 |
| 8,640,682 | B2 | * | 2/2014 | Shirk, II | F41G 11/001 124/20.1 |
| 8,925,535 | B2 | * | 1/2015 | Phillips | F41B 3/02 124/20.1 |
| 2003/0034019 | A1 | | 2/2003 | Lewis | |
| 2010/0294255 | A1 | | 11/2010 | Saunders | |
| 2010/0300419 | A1 | | 12/2010 | Saunders | |

OTHER PUBLICATIONS

EHS Slingshots, "GS-12 by Gopher Slingshots", on http://slingshotforum.com/gallery/image/4274-gs-12-by-gopher-slingshots/, uploaded Nov. 14, 2011, p. 1-2.

* cited by examiner

HANDLELESS SLINGSHOT WITH FOLDING STORAGE COMPARTMENT

CROSS REFERENCE TO RELATED APPLICATIONS

This application is a continuation of U.S. application Ser. No. 14/216,243, filed Mar. 17, 2014, which claims benefit of U.S. Provisional Patent Application Ser. No. 61/787,911, filed on Mar. 15, 2013, the disclosure of each of which is incorporated herein by reference.

BACKGROUND OF THE INVENTION

The present invention relates generally to slingshots and, more particularly, to a handleless slingshot with a folding storage compartment.

Slingshots commonly are used for recreation and for hunting. Although slingshots have existed for centuries, the basic design and mechanics have remained constant over time. Quite simply, a traditional slingshot comprises a handle and a pair of arms extending divergently upward from the handle. An elastic band is attached between the arms. Typically, centered on the elastic band is a pouch designed to hold a projectile.

After a projectile is placed in the pouch, the pouch is pulled backwards, away from the arms, thereby extending and stretching the elastic band to create potential energy. When the pouch is released, the potential energy of the elastic band is transformed to kinetic energy which is transferred to the projectile through the pouch. The projectile then is thrust forward, out of the pouch, and away from a slingshot shooter and toward a desired target.

Various design enhancements have been made over the years in an attempt to improve the functionality and performance of slingshots. For example, such improved slingshot devices include arm and wrist braces to help stabilize shots, foldable designs to make devices more portable, aiming mechanisms to improve accuracy, multi-band designs to improve band life and increase shot speed and pulley assemblies to produce maximum projectile velocity with minimum force exertion by the user.

One such improved slingshot design is disclosed in U.S. Pat. No. 5,230,323 to Saunders et al., the disclosure of which is fully incorporated herein by reference. Saunders discloses an arm-braced slingshot having a handle, a hook assembly, a pair of elastic bands, a pouch, an arm brace and a retaining clip. The arm brace comprises a generally U-shaped collar having an intermediate yoke portion which is dimensioned to be received in a peripheral recess of the handle. The distal ends of the collar are provided with an arm strap extending therebetween which extends over the user's forearm when the handle is gripped in the normal manner during use of the slingshot.

The slingshot disclosed in Saunders has been updated and improved over time with respect to the types of bands, pouches and connection mechanisms used with the slingshot. Modern variations of the Saunders slingshot design utilize flat bands, quick-snap band connection/replacement mechanisms and unique pouch designs, among other features. For example, U.S. Pat. No. 8,347,868 to Saunders, the disclosure of which is fully incorporated herein by reference, discloses a collapsible locking slingshot having a quick-release interchangeable band system that uses clips that matingly engage grooves formed at the ends of the slingshot arms.

Despite all of the innovations in slingshot technology, slingshot portability and size remains an unsolved issue.

Since most slingshots still include a handle, a pair of arms extending from the handle, an elastic band attached between the arms, and a pouch centered on the band and designed to hold a projectile, even collapsible and foldable slingshot designs can be bigger and less portable than desired. Because of the forces involved shooting a traditional slingshot, handles, braces and other mechanical features have become a necessity in order to counterbalance the forces generated during the process of shooting a slingshot and to thereby help achieve an accurate shot. However, these mechanical features add size and bulk, and thus decrease portability of the slingshot.

What is needed, therefore, is a slingshot that does not require a handle in order to shoot it. Preferably, but not necessarily, such a handleless slingshot includes a storage compartment that can store projectiles (such as steel shot) and/or other supplies. More preferably, the storage compartment is foldable such that it can be folded into the base of the slingshot to create a compact, portable unit. More preferably yet, such a slingshot includes a quick-release interchangeable band system that uses clips that matingly engage grooves formed at the ends of the slingshot arms. More preferably still, such a slingshot includes guard area which protects the web area of the hand when shooting the slingshot. Most preferably, such a slingshot moves the thumb and index finger pressure (contact) points forward of the band to increase stability and eliminate the need to grip a handle when shooting the slingshot. The present invention satisfies this need.

BRIEF SUMMARY OF THE INVENTION

According to one aspect, there is provided a handleless slingshot, the slingshot including a body, a pair of integrated arms extending from the body, each arm having an upper portion with a groove formed therein, the groove configured to receive a clip to secure a band, and a lower portion formed as a wing, the wing extending outwardly from the upper portion of the arm and forming a gap between the wing and the upper portion, and a storage compartment hingedly connected to the body. The body includes a guard area formed and extending between each arm, and a pair of recesses formed in the body within respective gaps. The storage compartment is foldable from an unfolded position generally perpendicular to the guard area of the body to a folded position generally parallel to the guard area of the body. The recesses formed in respective gaps form a gripping portion for a user to manipulate and operate the slingshot.

According to another aspect, there is provided a handleless slingshot including a body having a guard area, and a pair of integrated arms extending from the body, each arm having an upper portion with a groove formed therein, the groove configured to receive a clip to secure a band, and a lower portion formed as a wing, the wing extending outwardly from the upper portion of the arm such that a gap is formed between the wing and the upper portion, wherein the guard area extends between the arms and rearward relative to the grooves. The handleless slingshot further includes a gripping portion formed by a recess in each gap between the upper portion and the wing of each arm, and a storage compartment pivotably secured to the body, the storage compartment pivotable between a folded position where the storage compartment is positioned between the first and second arms, and an unfolded position where the storage compartment extends substantially perpendicularly away from an underside of the body.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
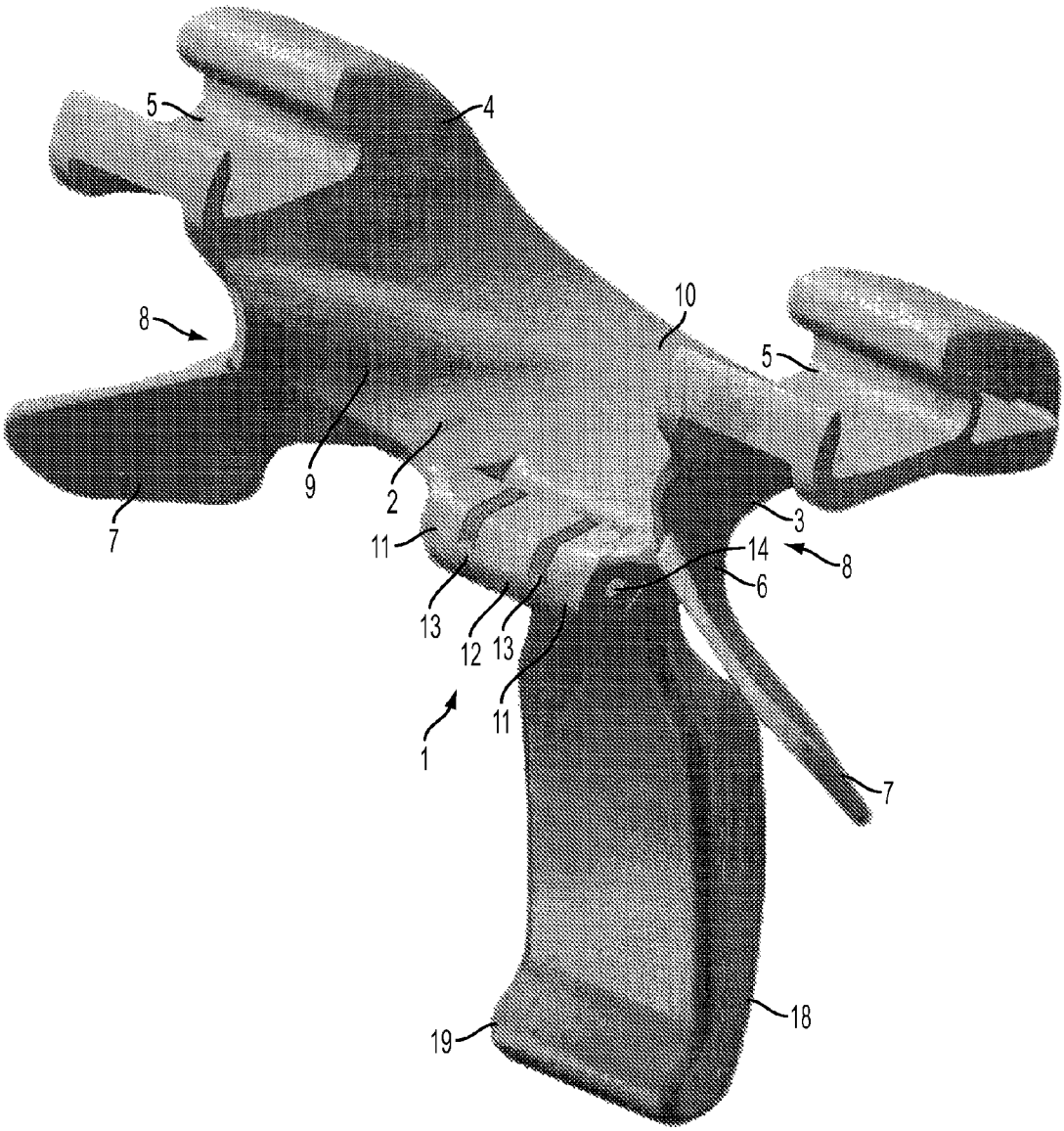
FIGS. 1 and 15 are front perspective views of a handleless slingshot with folding storage compartment embodying the principles of the claimed device, with the folding storage compartment in the unfolded (open) and locked position.
Figure 2:
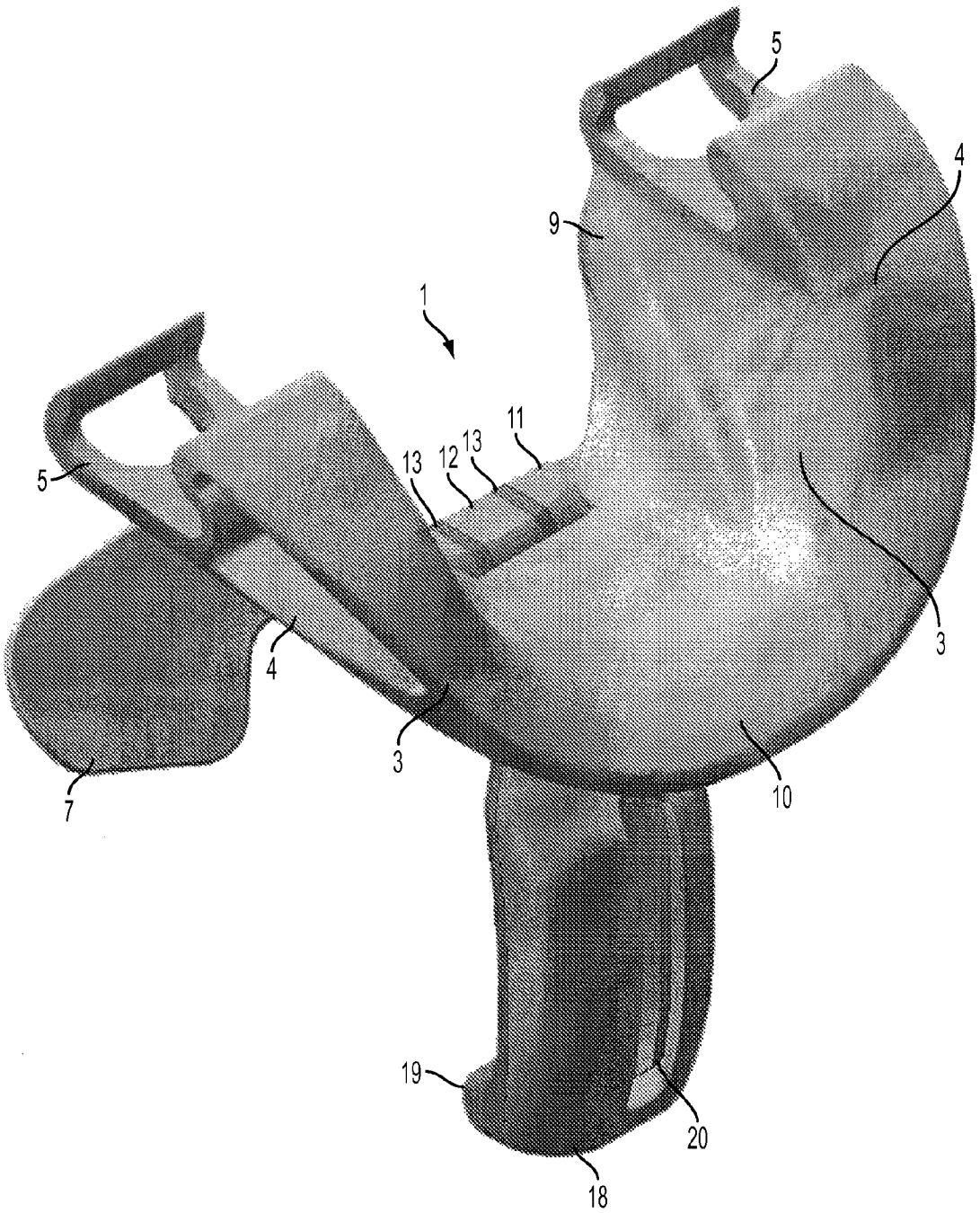
FIG. 2 is a rear perspective view of the handleless slingshot of FIGS. 1 and 15.
Figure 3:
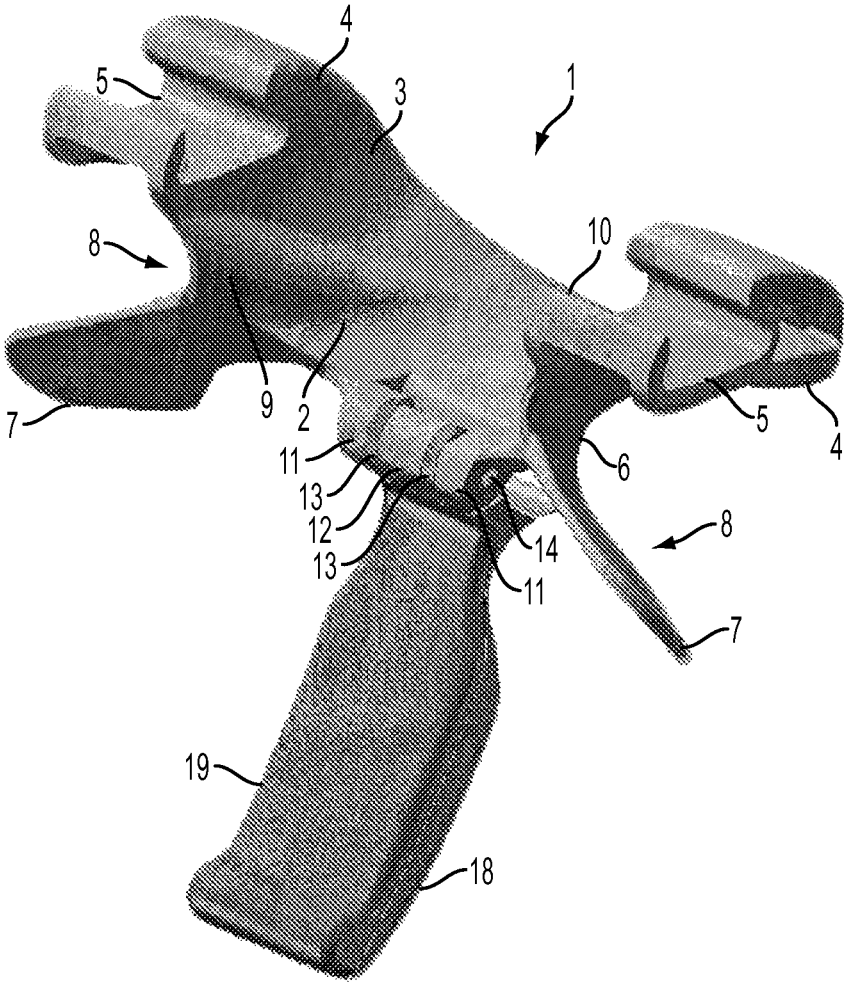
FIG. 3 is a front perspective view of the handleless slingshot of FIGS. 1 and 15, with the folding storage compartment in a partially folded position.
Figure 4:
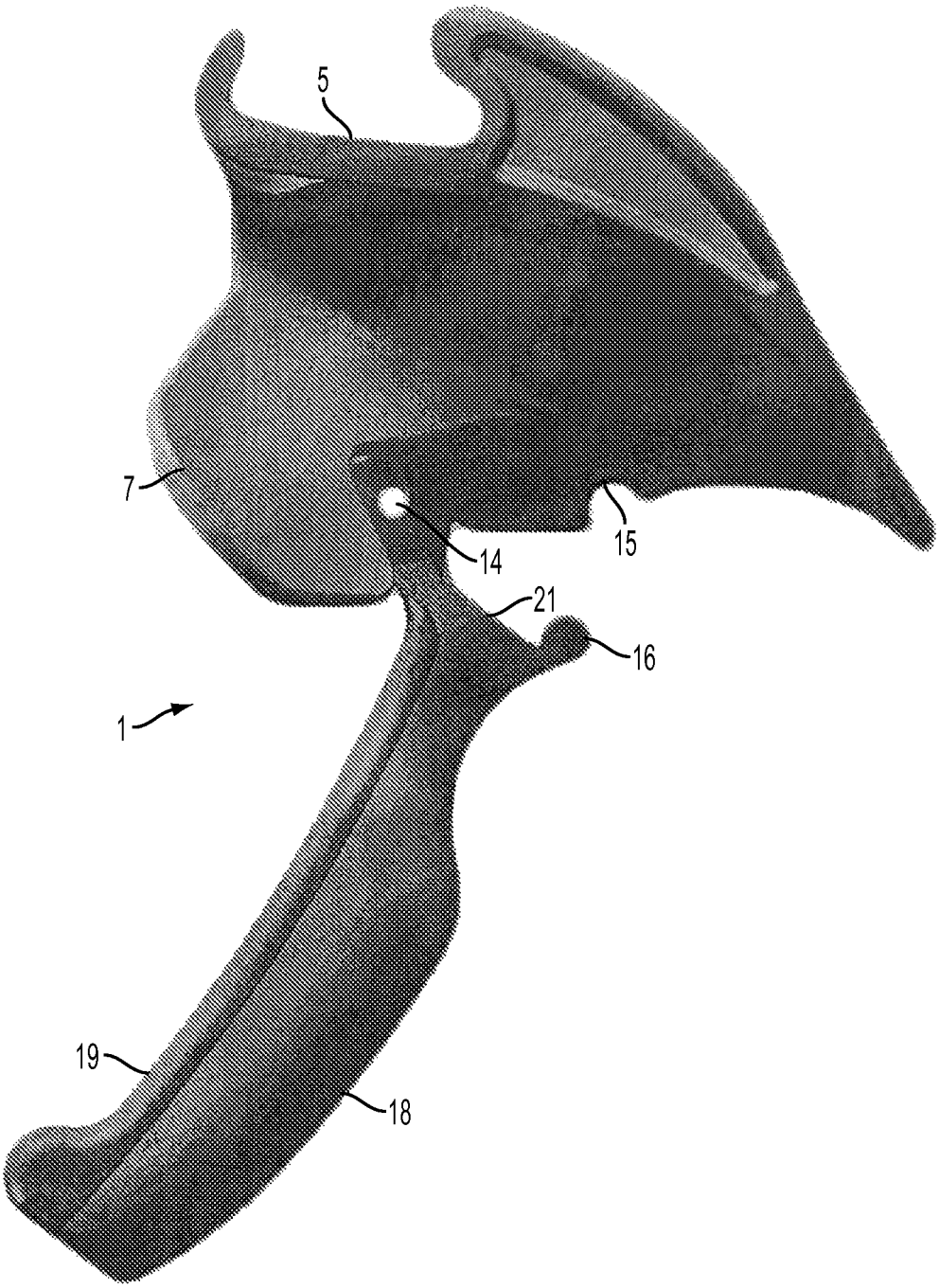
FIG. 4 is a right side view of the handleless slingshot of FIG. 3.
Figure 5:
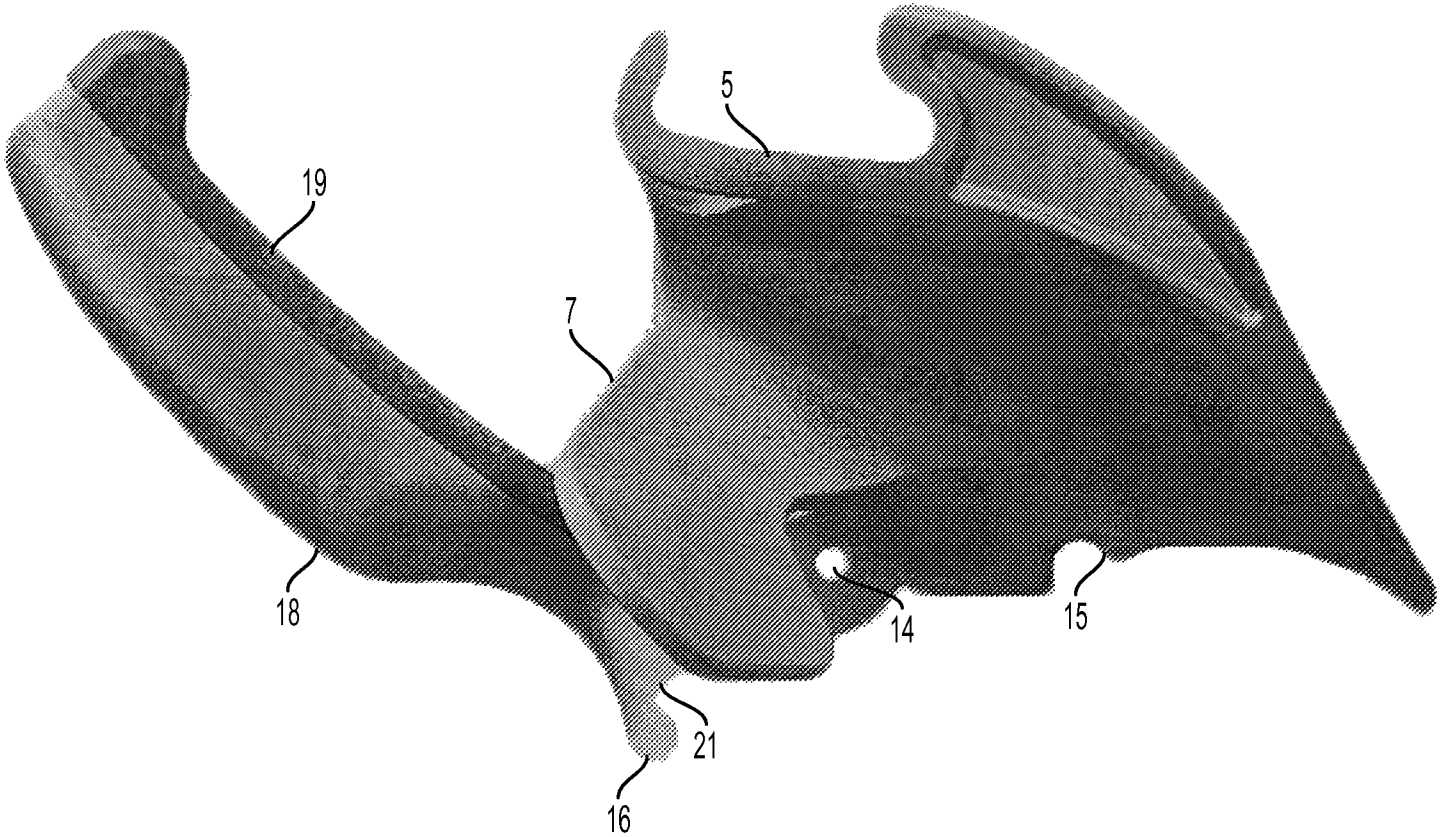
FIG. 5 is a right side view of the handleless slingshot of FIGS. 1 and 15, showing the folding storage compartment in a further partially folded position.
Figure 6:
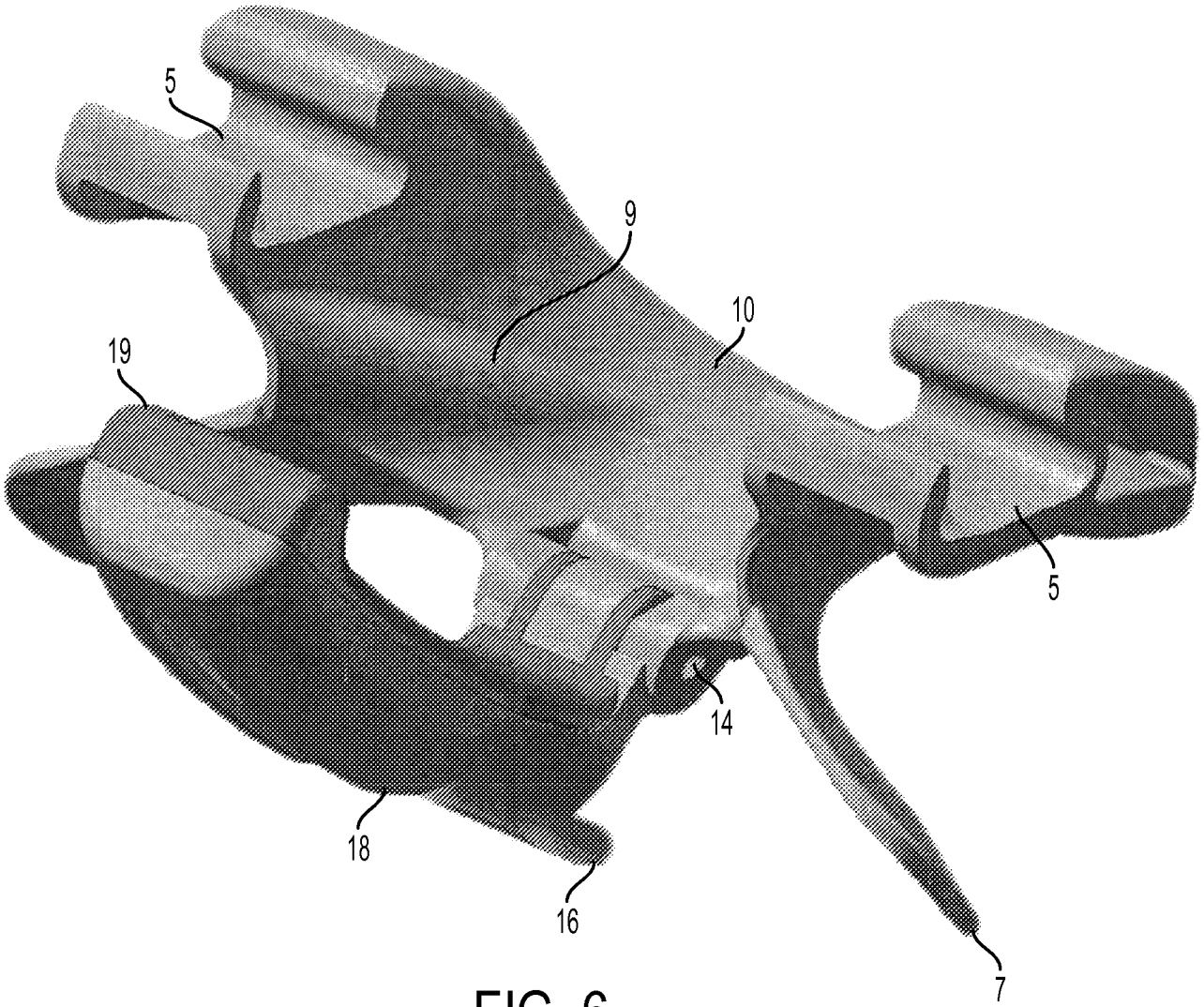
FIG. 6 is a front perspective view of the handleless slingshot of FIG. 5.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description of the Invention," relates to a requirement of the United States Patent Office, and does not imply, nor should be inferred to limit the subject matter disclosed herein.

FIGS. 1-25 illustrate a handleless slingshot with folding storage compartment embodying the principles of the claimed device.

As shown in FIGS. 1-25, slingshot 1 comprises a body 2 formed as a generally arcuate member having a pair of integrated arms 3 extending therefrom. An upper portion 4 of each arm 3 is formed as a groove 5 configured to receive a clip (not shown) in order to secure a band (not shown) to each arm 3 as is known in the art. A lower portion 6 of each arm 3 is formed as a wing 7 extending outwardly from arm 3.

In the disclosed embodiment, wings 7 are angled downwardly so as to create a gap or channel 8 between the top surface of each wing 7 and the underside of each groove 5. Gap or channel 8 is formed to provide a location where a user may contact slingshot 1 with the upper ends of the user's thumb and index finger when shooting slingshot 1, as further described below. Recesses 9 formed on either side of body 2 between the top surface of each wing 7 and the underside of each groove 5 provide guides, or a gripping portion, to engage and position the user's thumb and index finger when shooting slingshot 1.

Body 2 of slingshot 1 further comprises in the disclosed embodiment a guard area 10 formed and extending between each arm 3. Guard area 10 protects the web area of user's hand (the area between the user's index finger and thumb) when slingshot 1 is held by the user during shooting (guard area 10 is cradled within the web area of the user's hand) and provides counter-torque when the band is drawn in preparation for shooting.

A base of body 2 of slingshot 1 is formed with a body hinge mechanism 11 configured to receive a mating storage compartment hinge mechanism 12, storage compartment lid hinge mechanism 13, and pin 14, as further discussed below.

In the disclosed embodiment of the claimed device, body 2 of slingshot 1 is formed as a single piece of rigid molded plastic. However, those skilled in the art will recognize that other suitable materials, preferably rigid, lightweight, and strong, may be used to form body 2 of slingshot 1 without departing from the scope of the present disclosure. Similarly, those skilled in the art will recognize that body 2 need not be molded as a single piece and may instead comprise individual pieces affixed to one another.

Slingshot 1 includes storage compartment 18, as noted above, and further includes a storage compartment lid 19. Storage compartment 18 is a generally elongated bowl-like member having a window 20 formed therein and a mounting base 21 at an end proximate to the body 2. Window 20 allows the user to see the contents of storage compartment 18 (such as the amount of lead shot or other projectile stored therein) without opening storage compartment lid 19. Mounting base 21 is formed at the upper end of storage compartment 18 and includes storage compartment hinge mechanism 12 formed integral therewith.

Also formed integral with mounting base 21 at the end opposite storage compartment hinge mechanism 12 is a latching mechanism. In one embodiment, the latching mechanism may be a clip 16. The clip 16 is configured to engage a cooperating latching mechanism 15 of body 2 of slingshot 1 in order to lock storage compartment 18 in an open position. In one embodiment, the cooperating latching mechanism may be a groove 15 formed in the body 2 of the slingshot. The latching mechanism and cooperating latching mechanism, for example, the clip 16 and the groove 15, are releasably engageable to secure the storage compartment 18 in the unfolded, open position, such that the storage compartment 18 extends substantially perpendicular to the body 2. The clip 16 may engage the groove 15, for example, by friction fit or interlocking fit. The clip 16 may be released from the groove 15 to move the storage compartment 18 to the folded position.

Storage compartment lid 19 is a generally flat, elongated member configured to engage and cover an open side of storage compartment 18. Storage compartment lid hinge mechanism 13 is formed at the upper end of storage compartment lid 19 and integral therewith. Storage compartment lid 19 and storage compartment 18 each may include a locking mechanism 22 formed thereon to provide a friction-fit engagement between storage compartment lid 19 and storage compartment 18 in order to keep storage compartment 18 closed. Locking mechanism 22 may also comprise a clip and groove, tab and slot, magnetic connectors, or any other locking mechanism as may be known to those skilled in the art. The locking mechanism 22 formed on one of the storage compartment 18 and storage compartment lid 19 corresponds to, i.e., matingly and releasably engages, the locking mechanism 22 formed on the other of the storage compartment 18 and storage compartment lid 19.

Storage compartment 18 and storage compartment lid 19 are pivotally (or hingedly) mounted to body 2 of slingshot 1 through body hinge mechanism 11, storage compartment hinge mechanism 12, storage compartment lid hinge mechanism 13, and pin 14. That is, in the disclosed embodiment, body hinge mechanism 11, storage compartment hinge mechanism 12, storage compartment lid hinge mechanism 13 are aligned coaxially and pin 14 is disposed therein. For example, each of the body hinge mechanism 11, storage compartment hinge mechanism 12, and storage compartment lid hinge mechanism 13 may include one or more openings aligned along a common axis, and the pin 14 may be inserted through the respective one or more openings of the body hinge mechanism 11, storage compartment hinge mechanism 12, and storage compartment lid hinge mechanism 13 to extend along the common axis. In this manner, storage compartment 18 and storage compartment lid 19 are able to pivotally rotate relative to each other to open storage compartment 18 in order to load supplies. In addition the storage compartment 18 and storage compartment lid 19 are able to pivot relative to body 2 of slingshot 1.

In the disclosed embodiment of the claimed device, storage compartment 18 and storage compartment lid 19 each are formed as a single piece of rigid molded plastic. However, those skilled in the art will recognize that other suitable materials, preferably rigid, lightweight, and strong, may be used to form storage compartment 18 and storage compartment lid 19 without departing from the scope of the present disclosure. Similarly, those skilled in the art will recognize that storage compartment 18 and storage compartment lid 19 need not be molded as single pieces and may instead comprise individual pieces affixed to one another.

Figure 7:
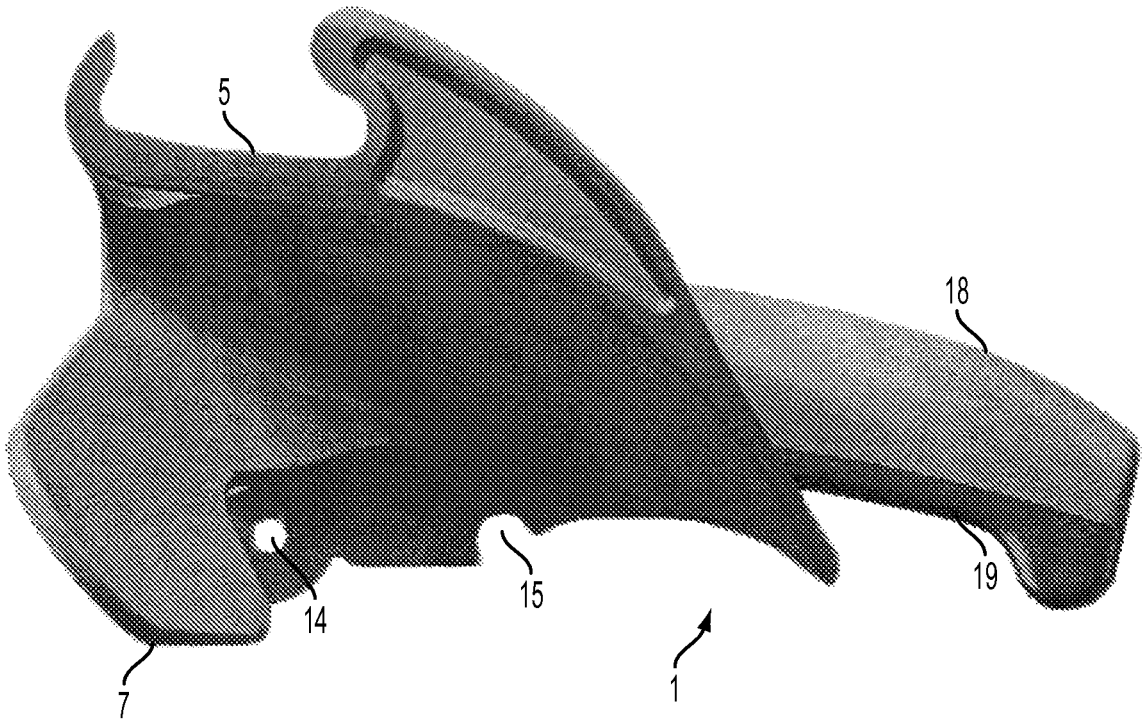
FIGS. 7 and 16 are right side views of the handleless slingshot of FIGS. 1 and 15, showing the folding storage compartment in a fully folded position.
Figure 8:
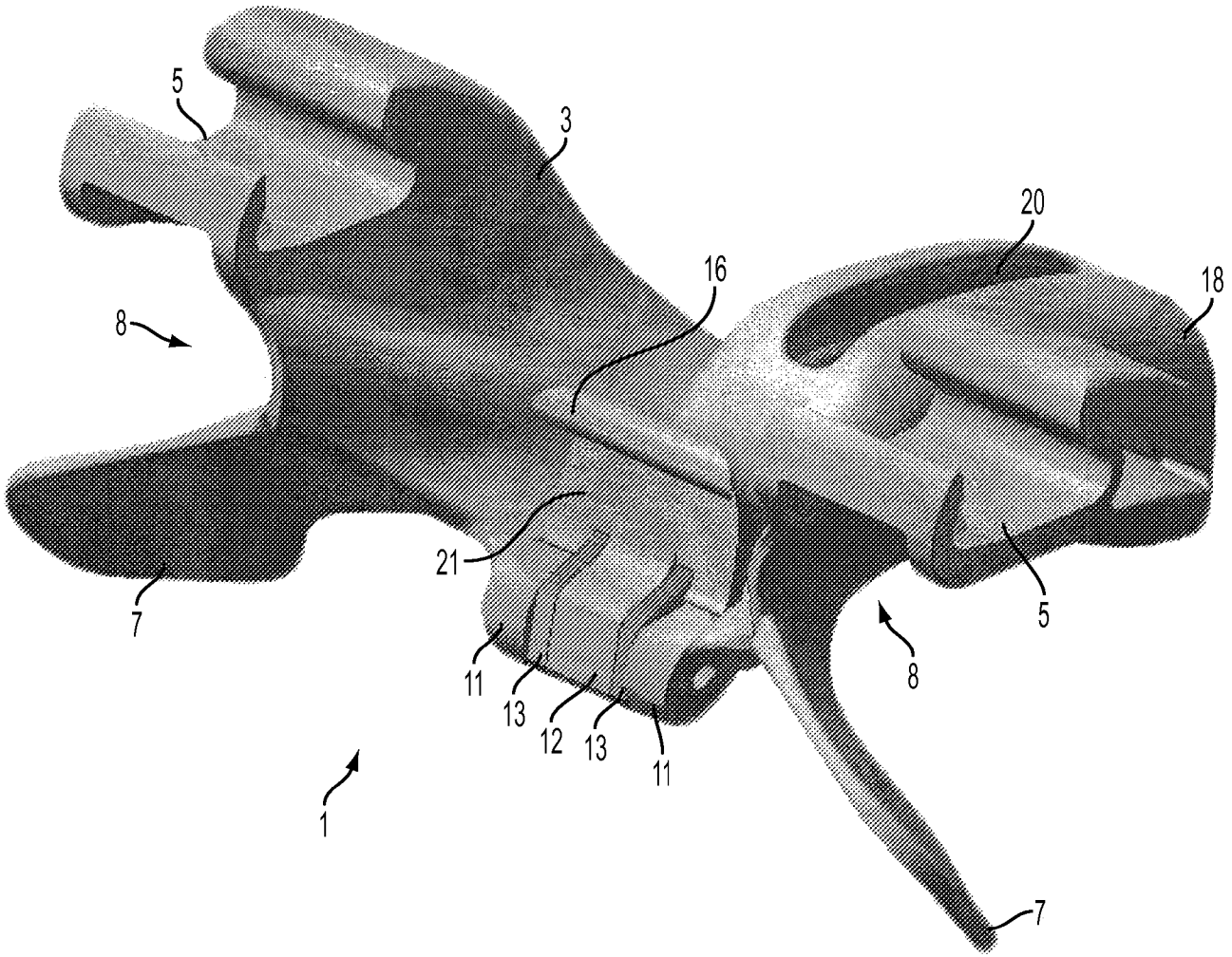
FIGS. 8 and 17 are front perspective views of the handleless slingshot of FIGS. 7 and 16.
Figure 9:
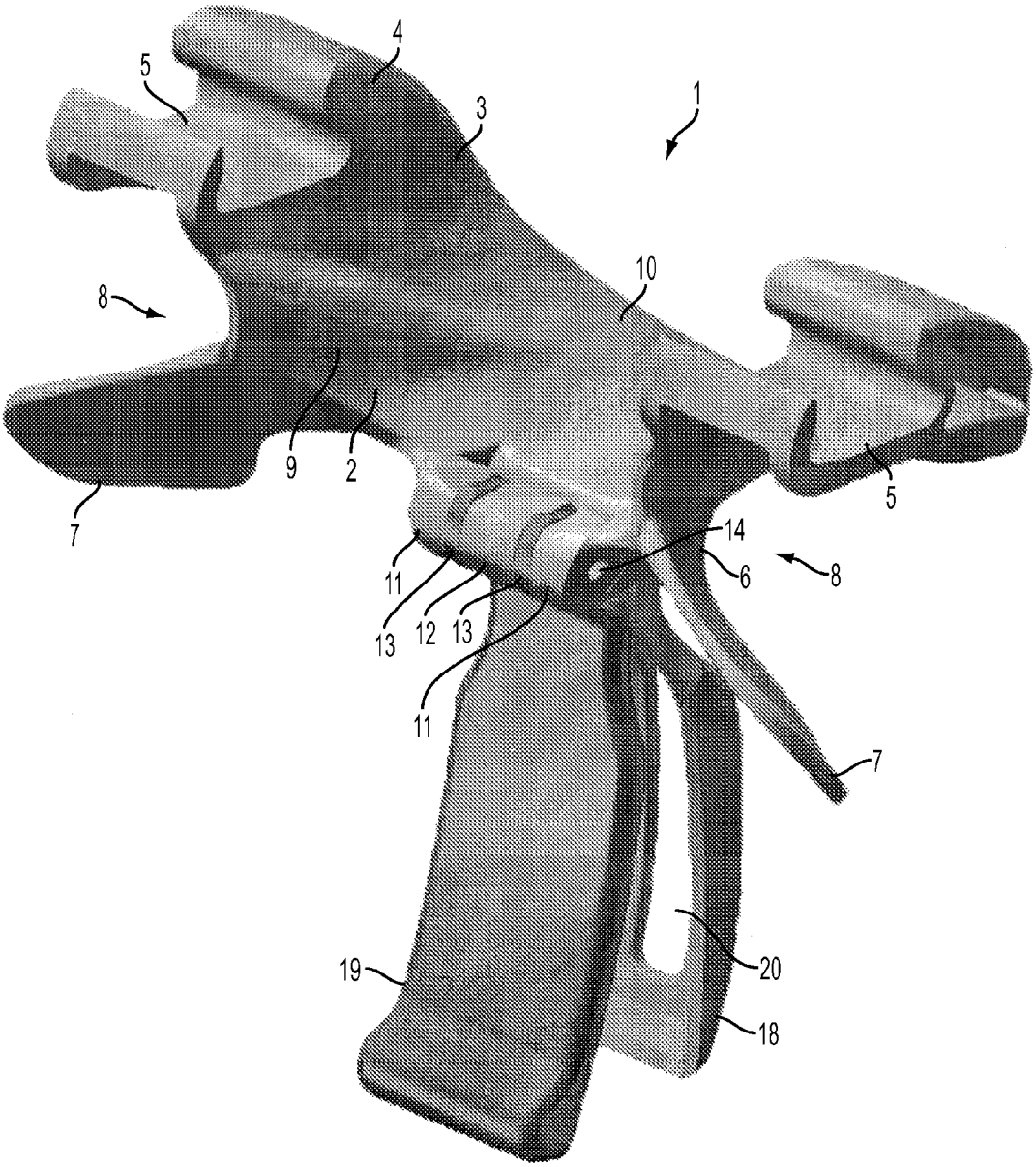
FIG. 9 is a front perspective view of the handleless slingshot of FIGS. 1 and 15, with the folding storage compartment open.
Figure 10:
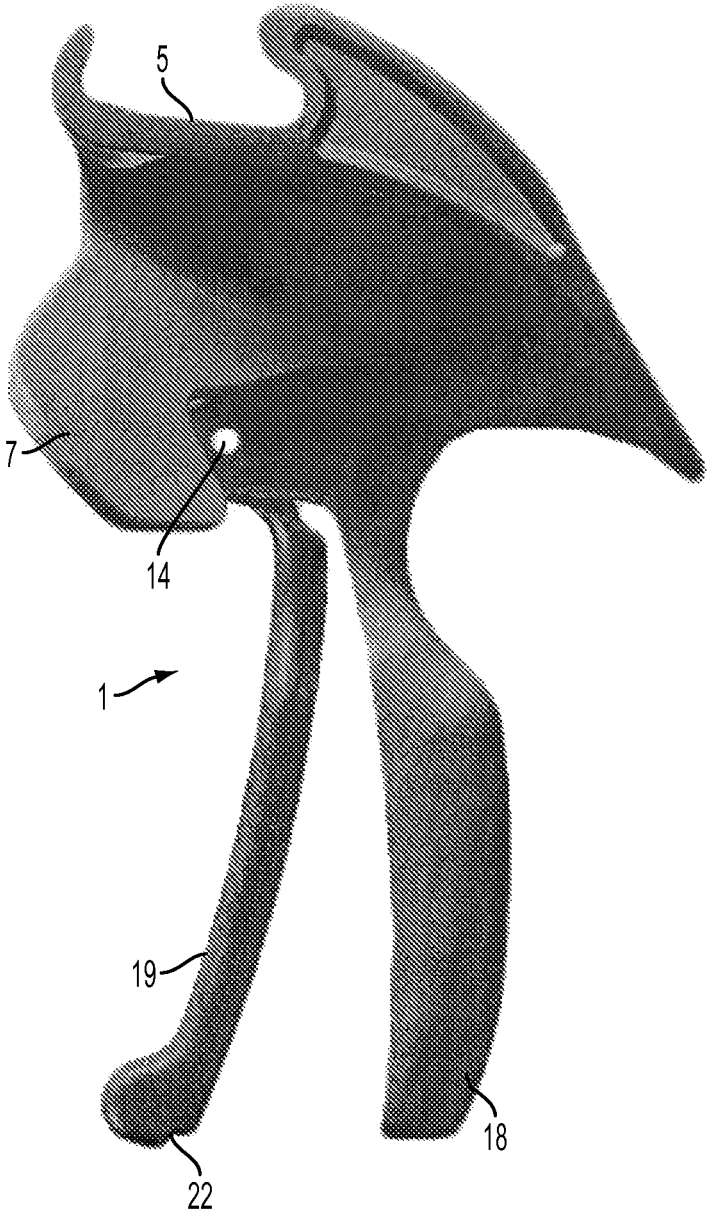
FIG. 10 is a right side view of the handleless slingshot of FIG. 9.
Figure 11:
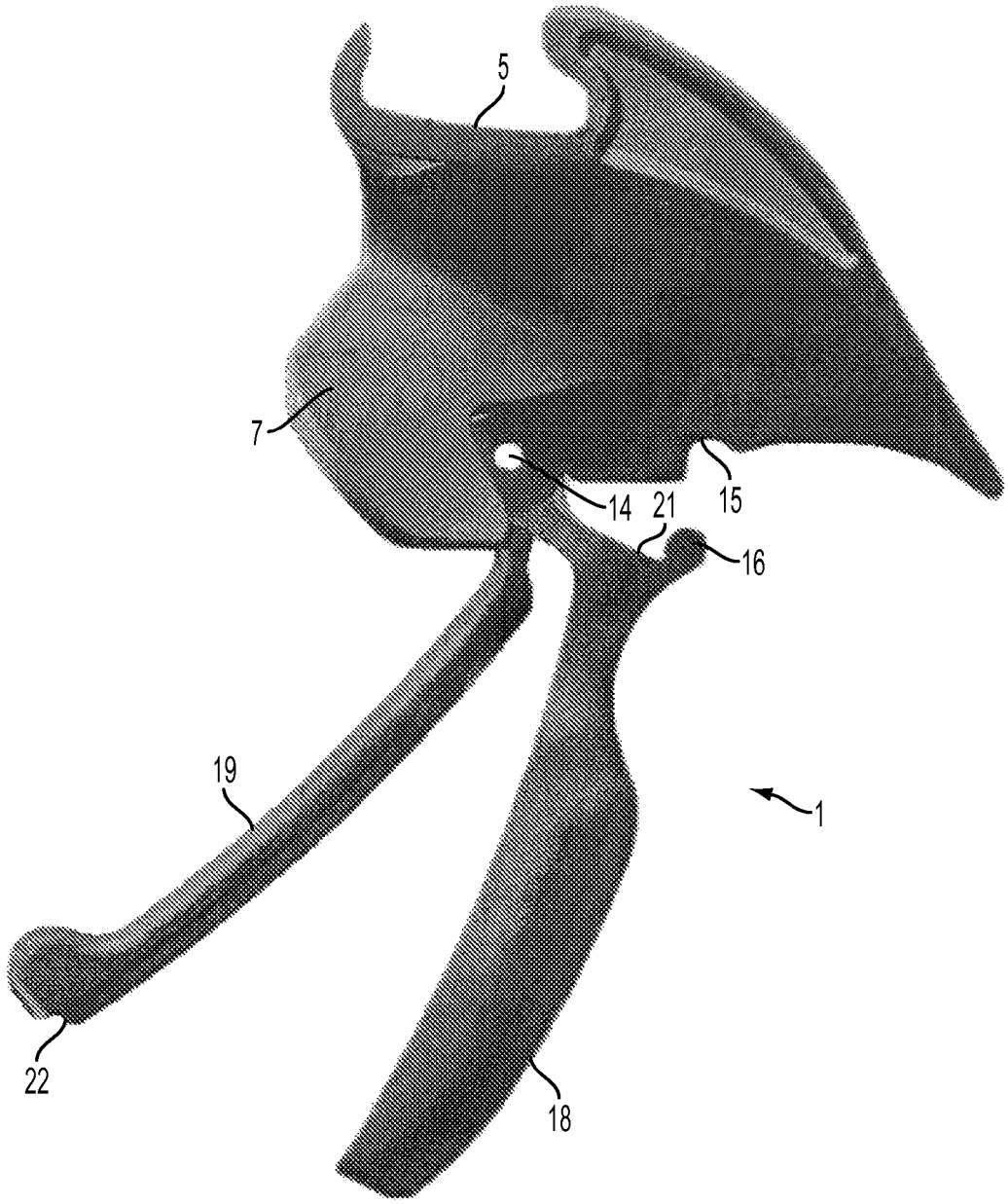
FIG. 11 is a right side view of the handleless slingshot of FIG. 9, showing the folding storage compartment in a partially folded position.
Figure 12:
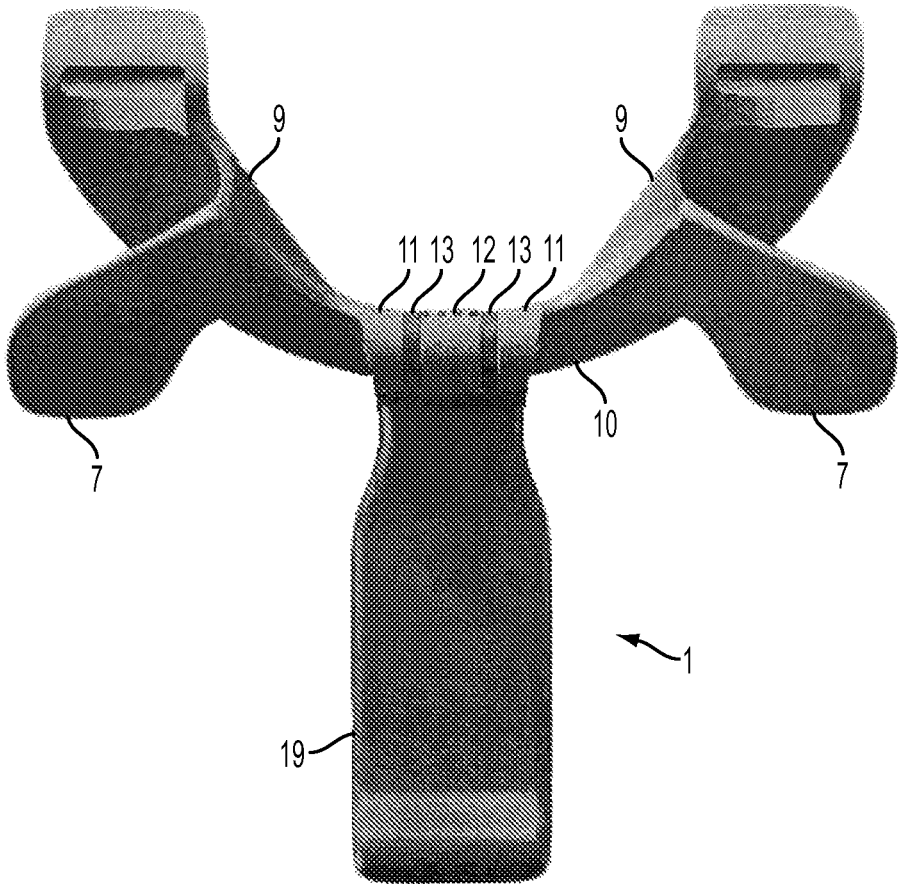
FIG. 12 is a front perspective view of the handleless slingshot of FIGS. 1 and 15.
Figure 13:
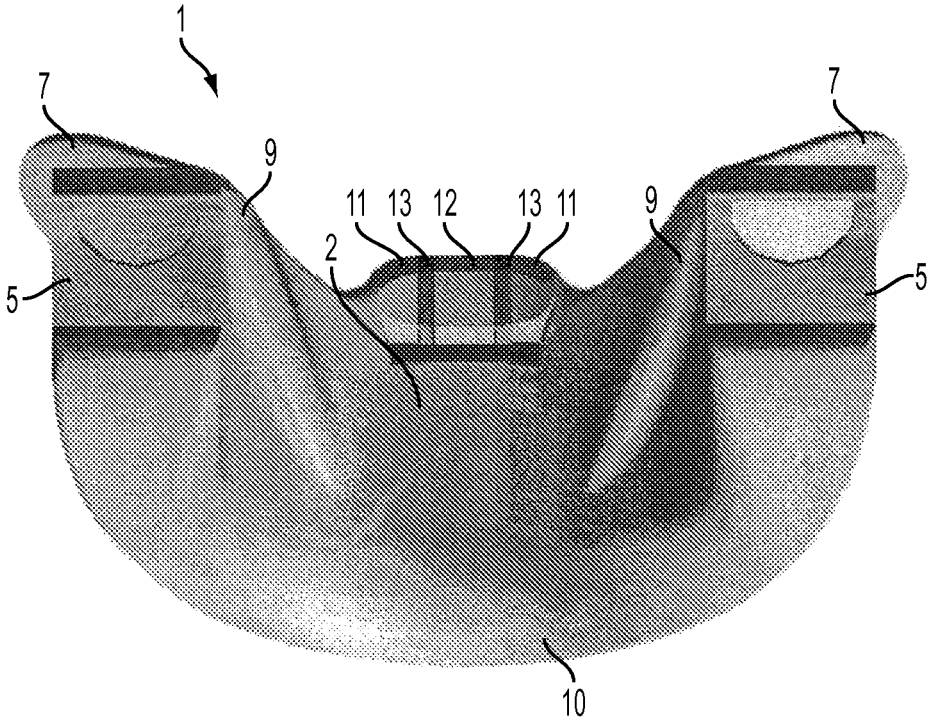
FIGS. 13 and 18 are top views of the handleless slingshot of FIGS. 1 and 15.
Figure 14:
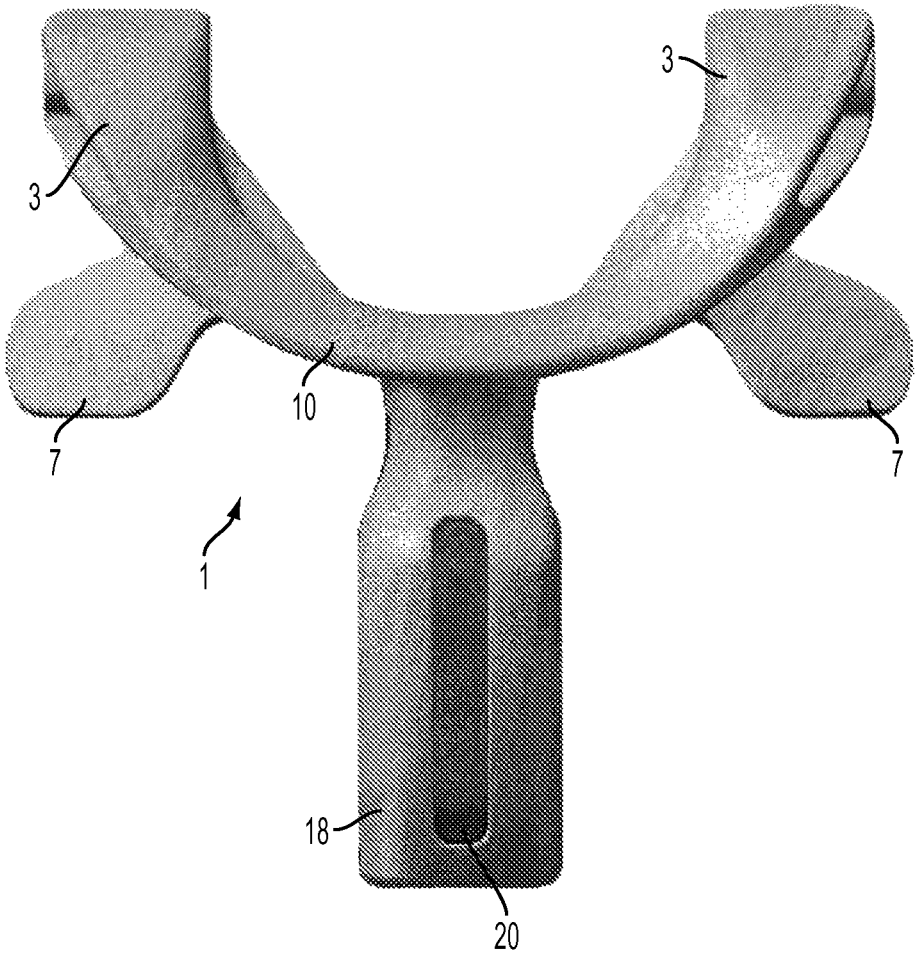
FIGS. 14 and 19 a rear views of the handleless slingshot of FIGS. 1 and 15.
Figure 15:
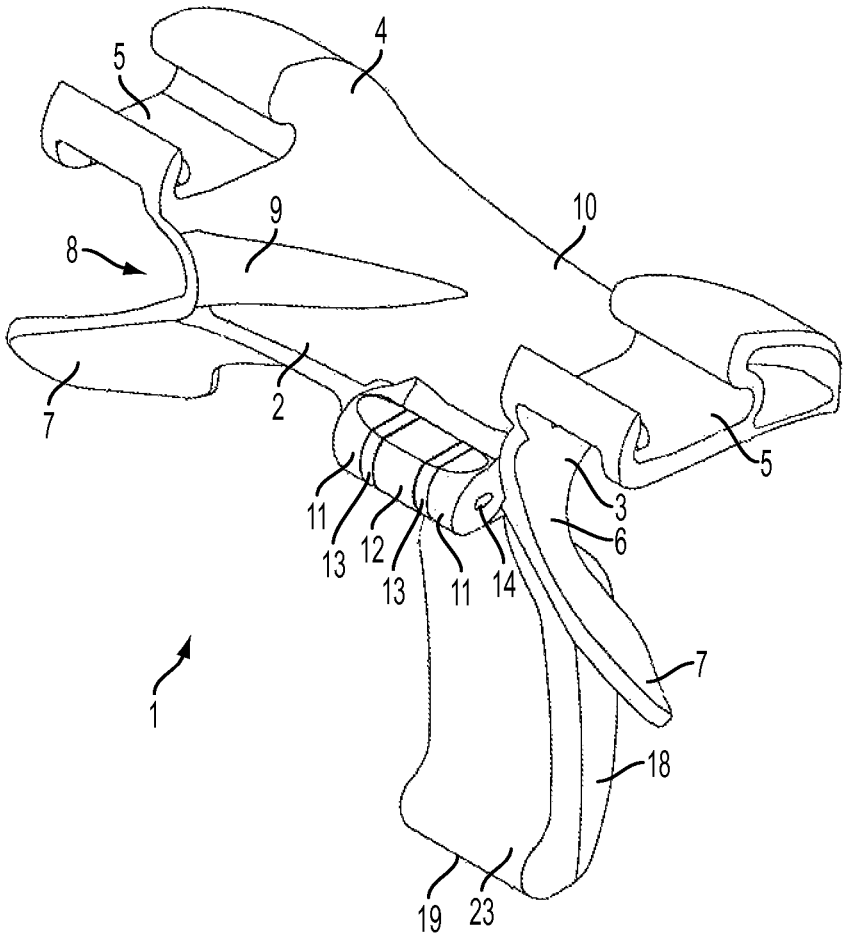
Figure 16:
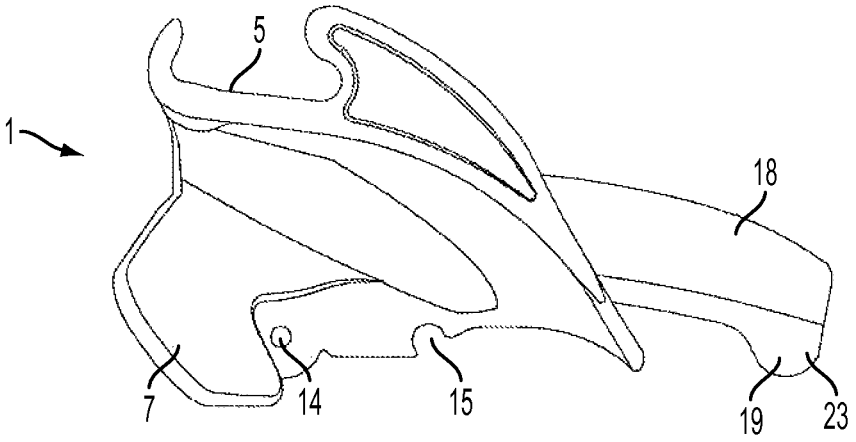
Figure 17:
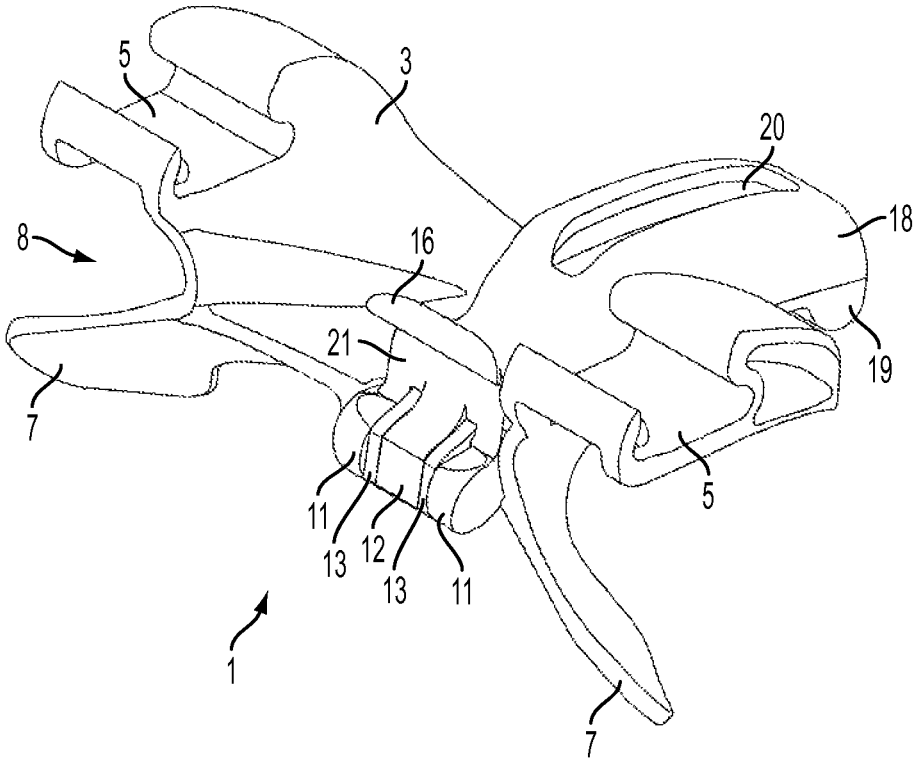
Figure 18:
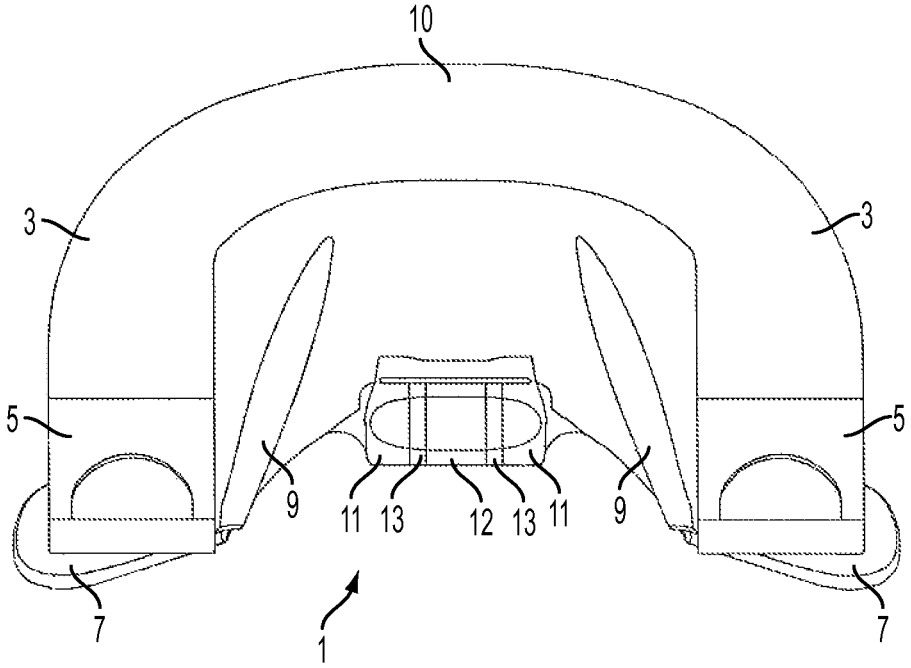
Figure 19:
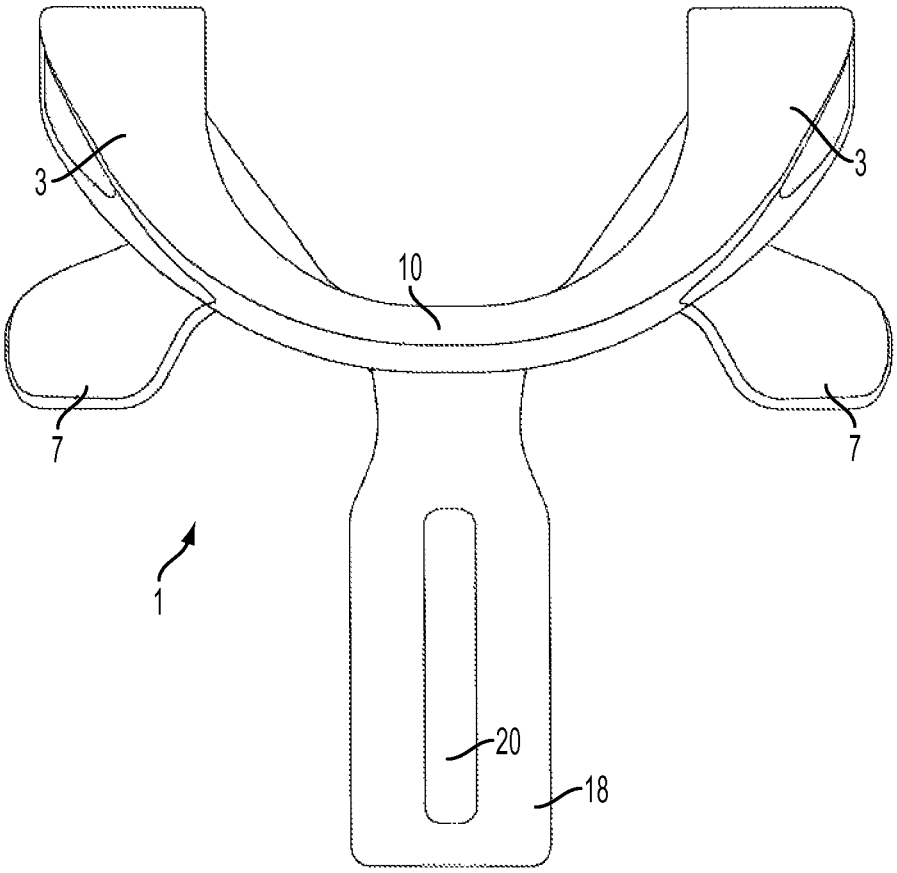
Figure 20:
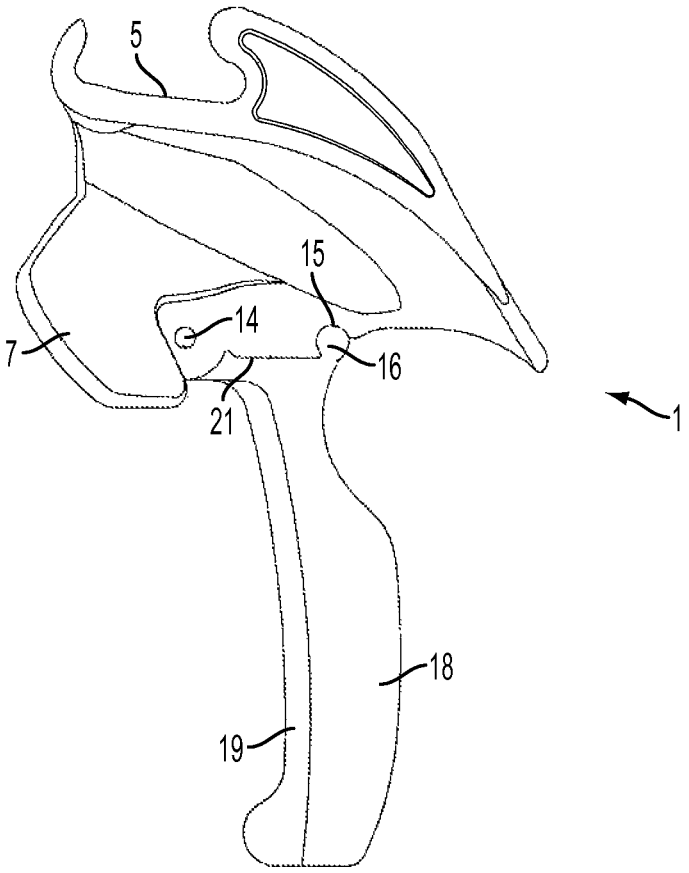
FIG. 20 is a right side view of the handleless slingshot of FIGS. 1 and 15.
Figure 21:
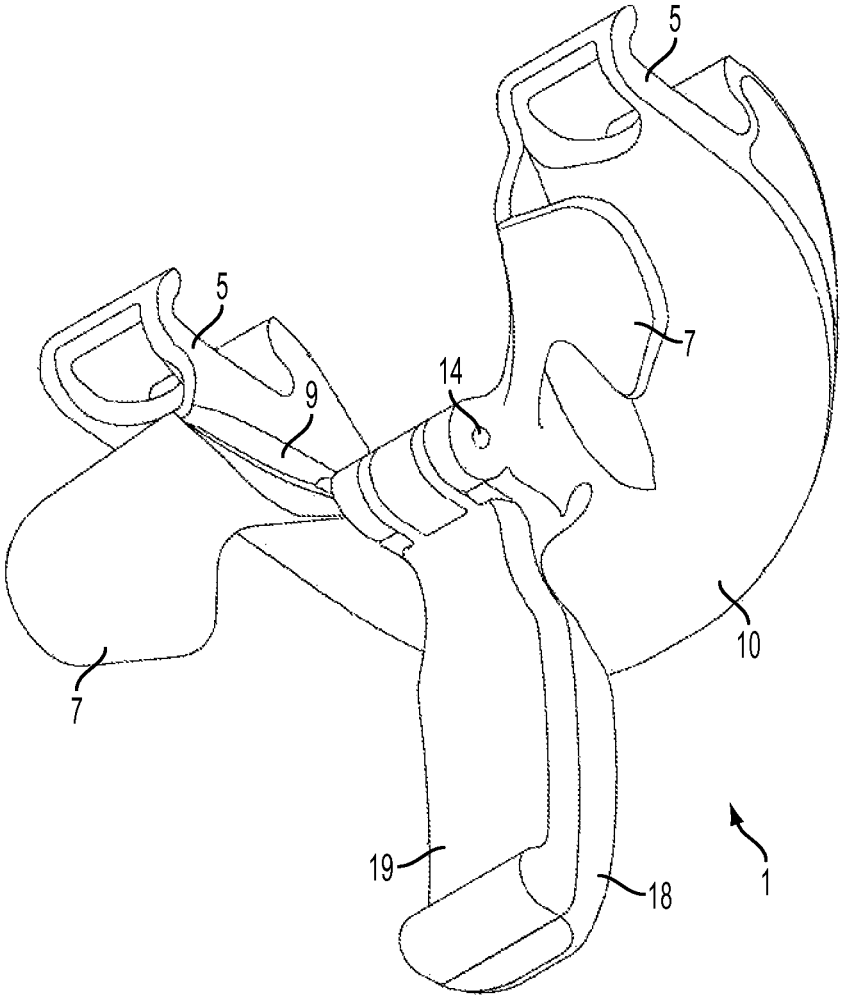
FIG. 21 is a bottom perspective view of the handleless slingshot of FIGS. 1 and 15.
Figure 22:
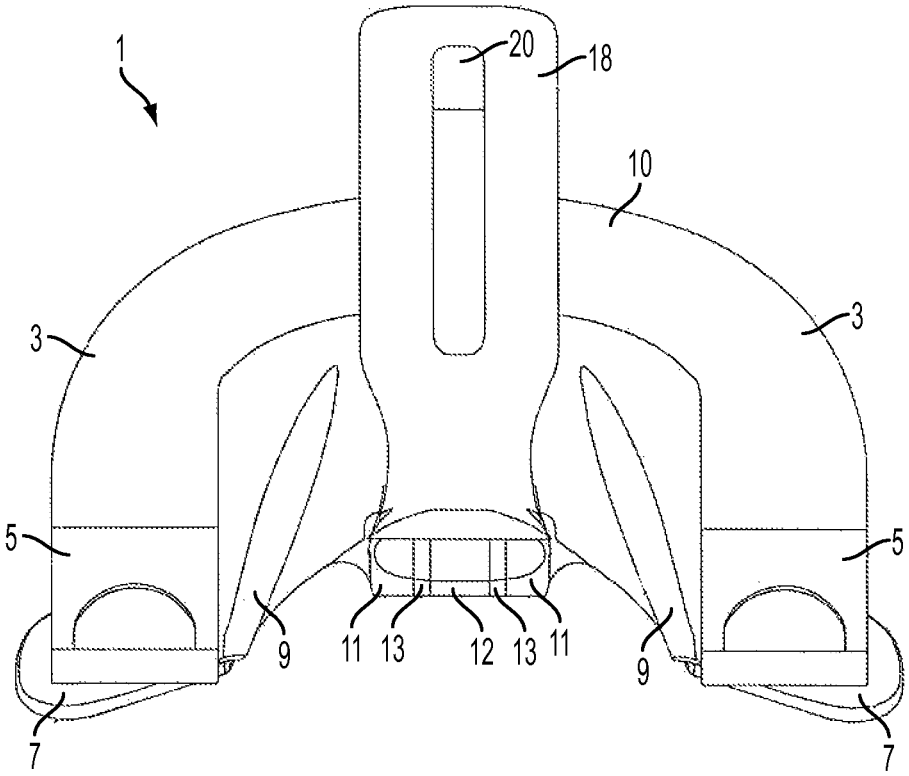
FIG. 22 is a top view of the handleless slingshot of FIGS. 7 and 16.
Figure 23:
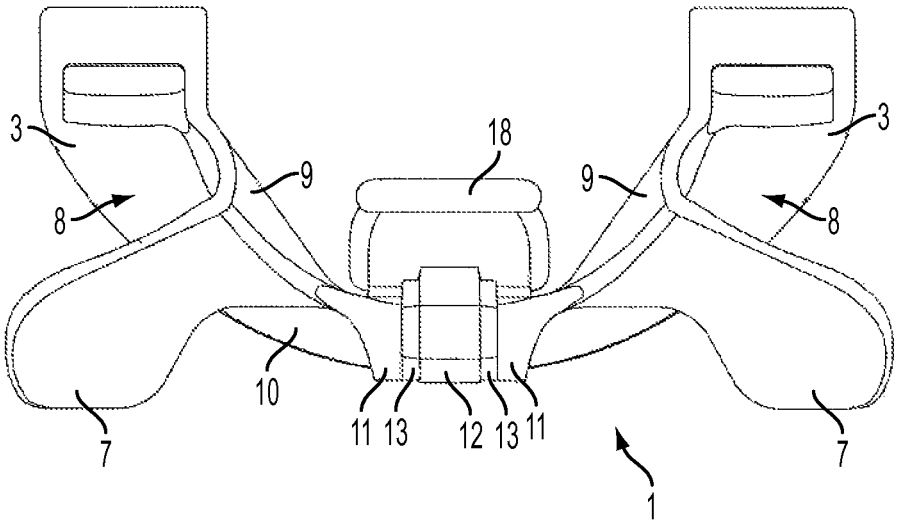
FIG. 23 is a front view of the handleless slingshot of FIGS. 7 and 16.
Figure 24:
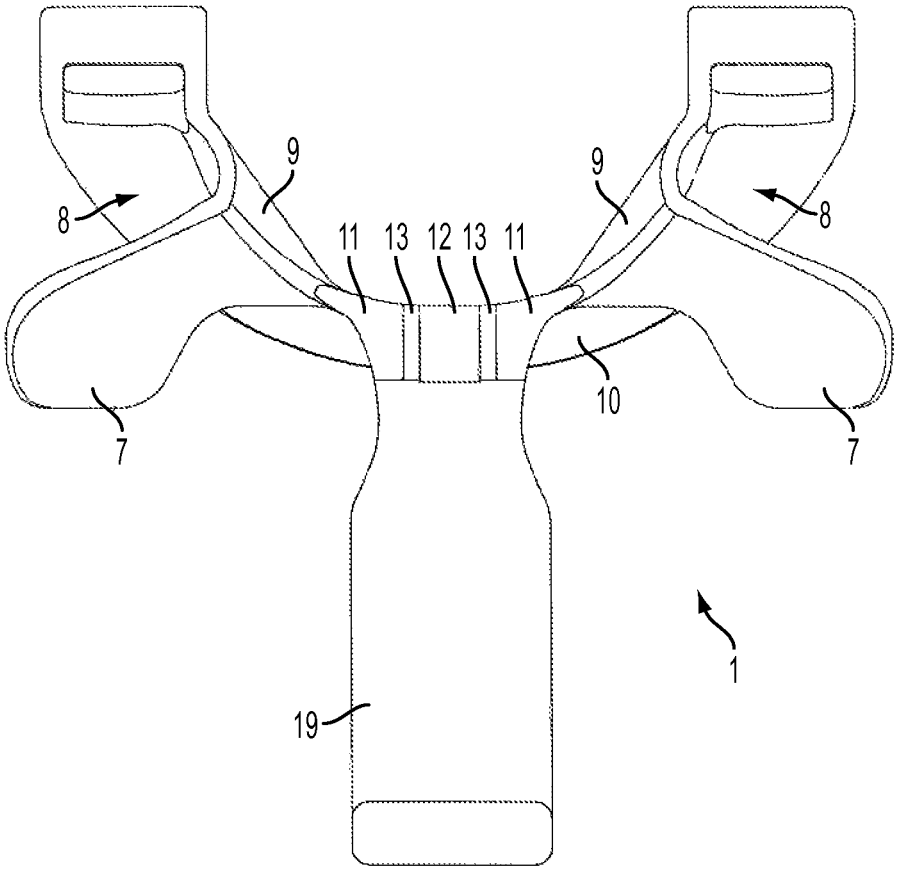
FIG. 24 is a front view of the handleless slingshot of FIGS. 1 and 15.
Figure 25:
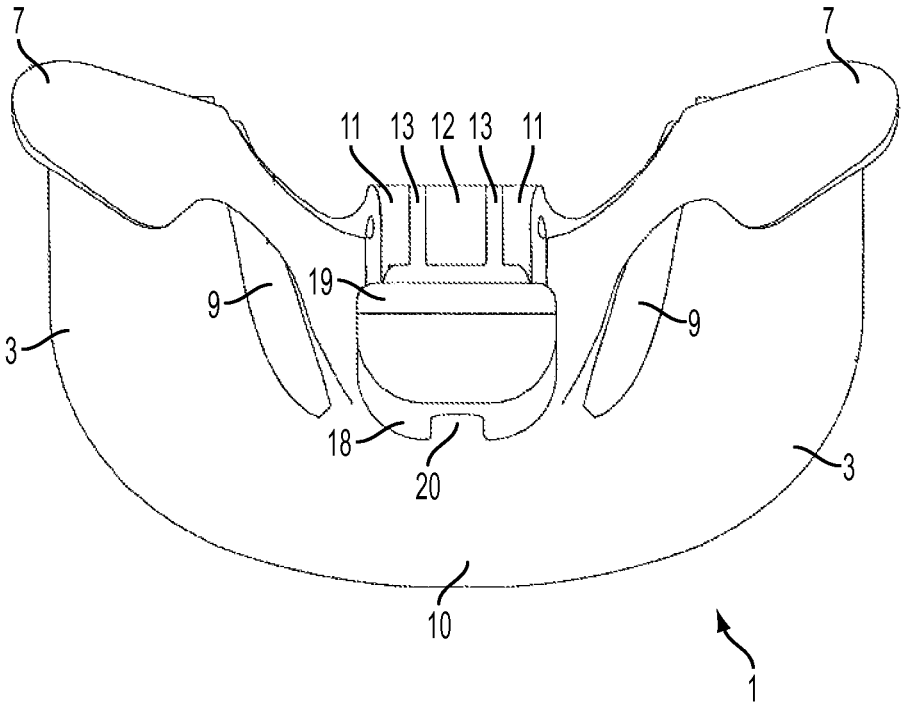
FIG. 25 is a bottom view of the handleless slingshot of FIGS. 1 and 15.

In a folded or stored configuration, shown in FIGS. 7-8, storage compartment 18 (closed with storage compartment lid 19) is disposed between arms 3 and generally parallel to guard area 10. This provides for a compact and portable device. In some embodiments, the storage compartment lid 19 may be contoured to match a contour of the body 2 in the folded position. In addition, the storage compartment lid 19 may include a foot 23 having an increased thickness relative to the rest of the storage compartment lid 19. The foot 23 may also contact the body 2 and have a mating contour with the body along this contact. To prepare slingshot 1 for use, a user unfolds storage compartment 18 (closed with storage compartment lid 19) by rotating storage compartment 18 through the front of slingshot 1 and downward until clip 16 engages groove 15 of body 2 of slingshot 1 to lock storage compartment 18 in an open position.

In an open, or unfolded, position (as shown, for example, in FIGS. 1, 9 and 10) storage compartment 18 may be opened by disengaging locking mechanism 22 and pivotally rotating storage compartment lid 19 away from storage compartment 18. This may be useful, for example, to load and/or remove shot or other supplies stored in storage compartment 18.

To shoot slingshot 1, storage compartment 18 and storage compartment lid 19 should be in the open and locked position. A user may then position guard area 10 of body 2 of slingshot 1 into the web of the user's hand between the user's thumb and index finger. The upper portions of the user's thumb and index finger should be in contact with groves 5 to correctly position slingshot 1.

When the band (not shown) is drawn, body 2 of slingshot 1 is torqued rearward, toward the user, and the guard area 10 engages the web of the user's hand to provide a minimal counter-torque. However, because the design of slingshot 1 moves the thumb and index finger pressure (contact) points forward of the band, slingshot 1 balances comfortably within the web of the user's hand without the need for the user to grip a handle when shooting the slingshot.

It will be appreciated that while storage compartment 18 is disposed in the vicinity of where a handle typically would be located in prior art slingshots when the user shoots the slingshot 1, storage compartment 18 need not be grasped or held by the user during shooting, and slingshot 1 may contact only the web of the user's hand and the user's thumb and index finger during shooting. Notwithstanding the foregoing, if desired by the user, storage compartment 18 may be used as a handle when in the open, unfolded and locked position.

It will be further appreciated that storage compartment 18 is optional on some embodiments of the claimed slingshot. That is, for maximum portability, storage compartment 18 (and storage compartment lid 19) may be removed from body 2 and/or body 2 may be formed without body hinge mechanism 11. In this manner the slingshot will operate as described above with the slingshot contacting only the web of the user's hand and the user's thumb and index finger during shooting.

FIGS. 26-33 show various views of a handleless slingshot 101 according to another embodiment, with a storage compartment in an open, unfolded and locked position. FIGS. 34-41 show various views of the handleless slingshot 101 of FIGS. 26-33 with the storage compartment in a folded position.

It is understood that various features of the embodiment shown in FIGS. 26-41 may be similar or identical to the features described above with reference to FIGS. 1-25, and that further description of these features may be omitted below. In addition, certain features described below that are similar or identical to features described above may be referenced below and shown in FIGS. 26-41 using the same reference numbers as above.

Referring to FIGS. 26-33, the handleless slingshot 101 includes a body 102 having a body hinge mechanism 111. The handleless slingshot 101 also includes a storage compartment 118 having a storage compartment hinge mechanism 112, and a storage compartment lid 119 having a storage compartment lid hinge mechanism 113. The storage compartment 118 and storage compartment lid 119 are pivotally, or hingedly, connected to the body 102 for movement between the unfolded position (FIGS. 26-33) and the folded position (FIGS. 34-41).

The storage compartment 118 and storage compartment lid 119 are pivotable about a common axis and may be pivoted or rotated together. In addition, the storage compartment lid, 119, may pivot relative to the storage compartment 118 to allow access to an interior of the storage compartment 118.

Figure 26:
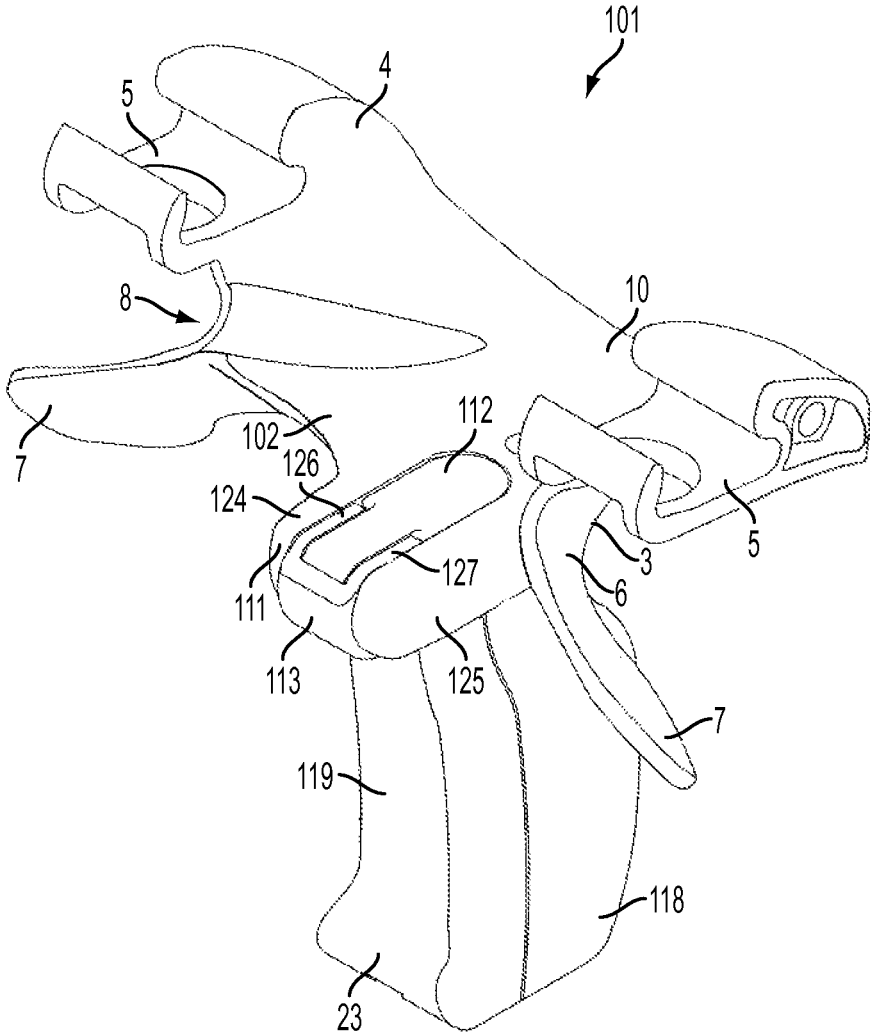
FIG. 26 is top, front perspective view of a handleless slingshot with a folding storage compartment in an unfolded (open) and locked position according to another embodiment.
Figure 27:
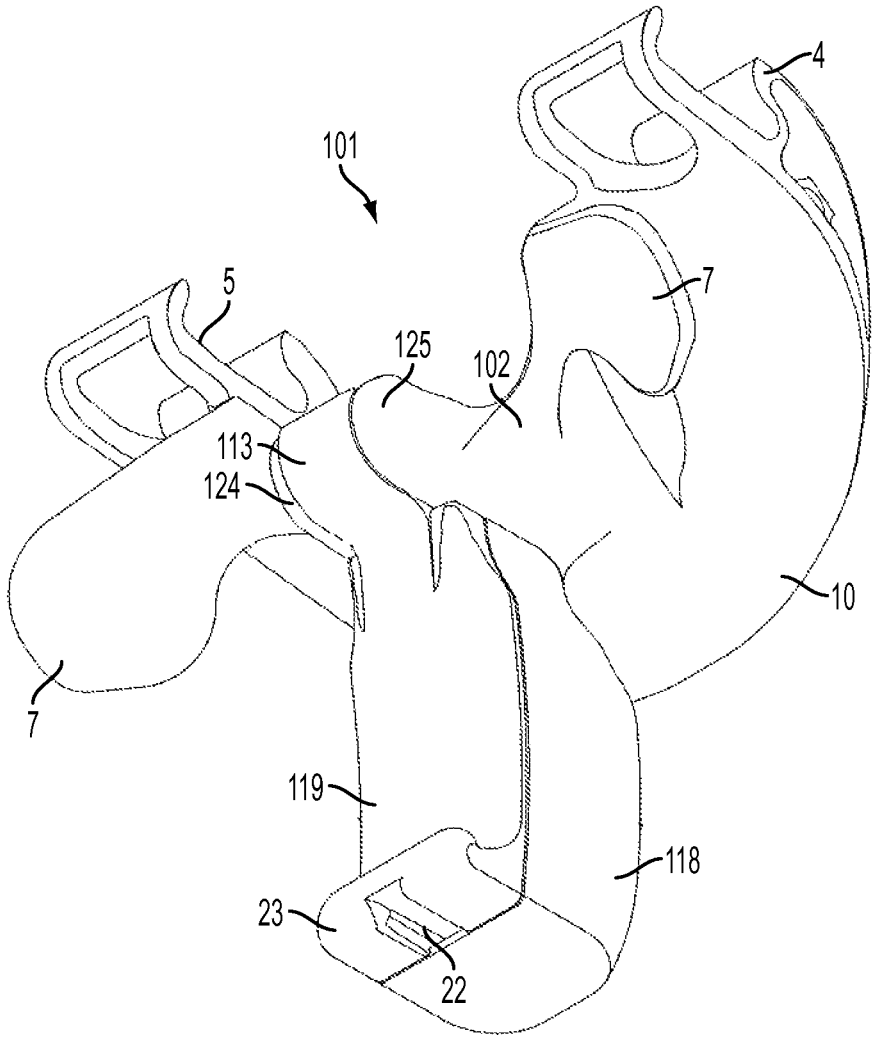
FIG. 27 is a bottom, front perspective view of the handleless slingshot of FIG. 26.
Figure 28:
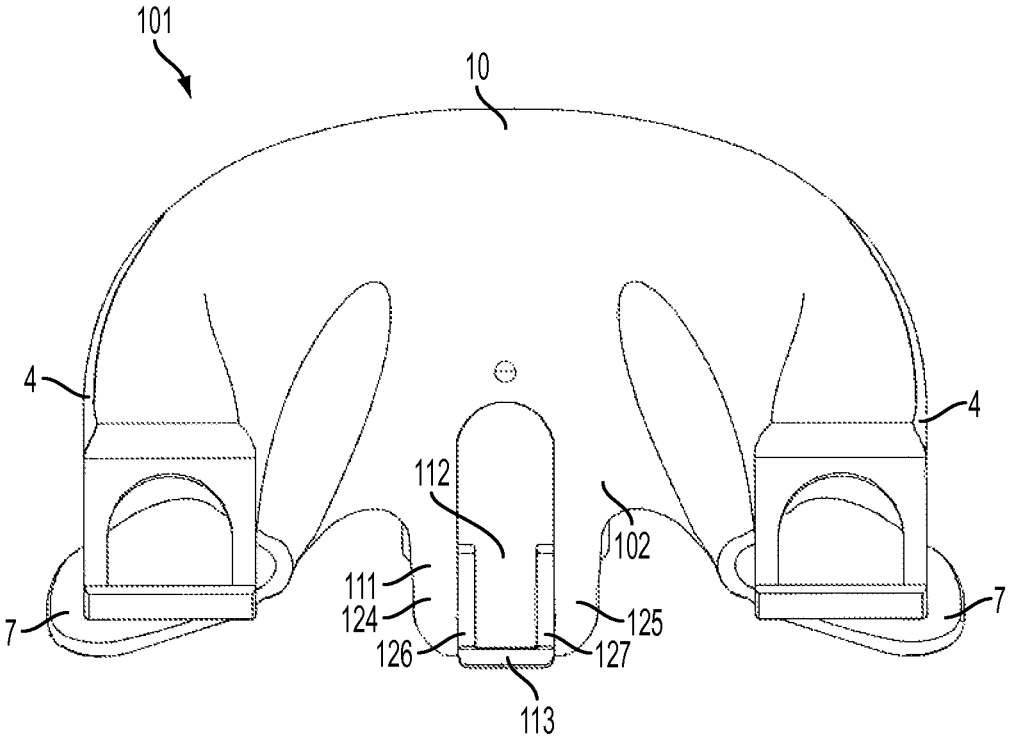
FIG. 28 is a top view of the handleless slingshot of FIG. 26.
Figure 29:
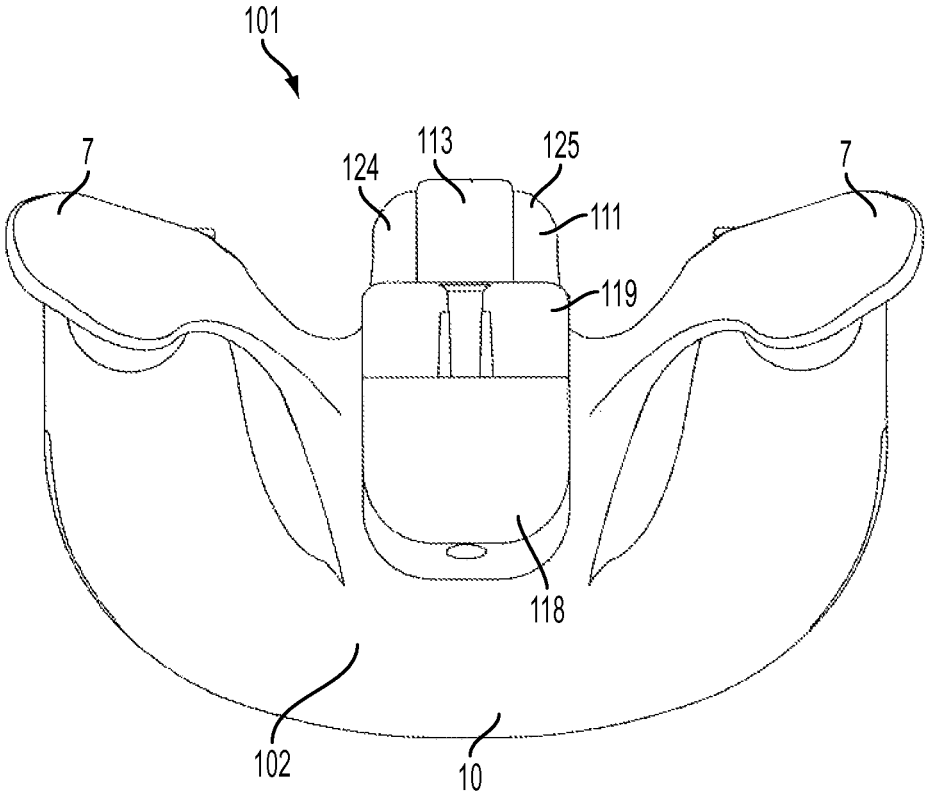
FIG. 29 is a bottom view of the handleless slingshot of FIG. 26.
Figure 30:
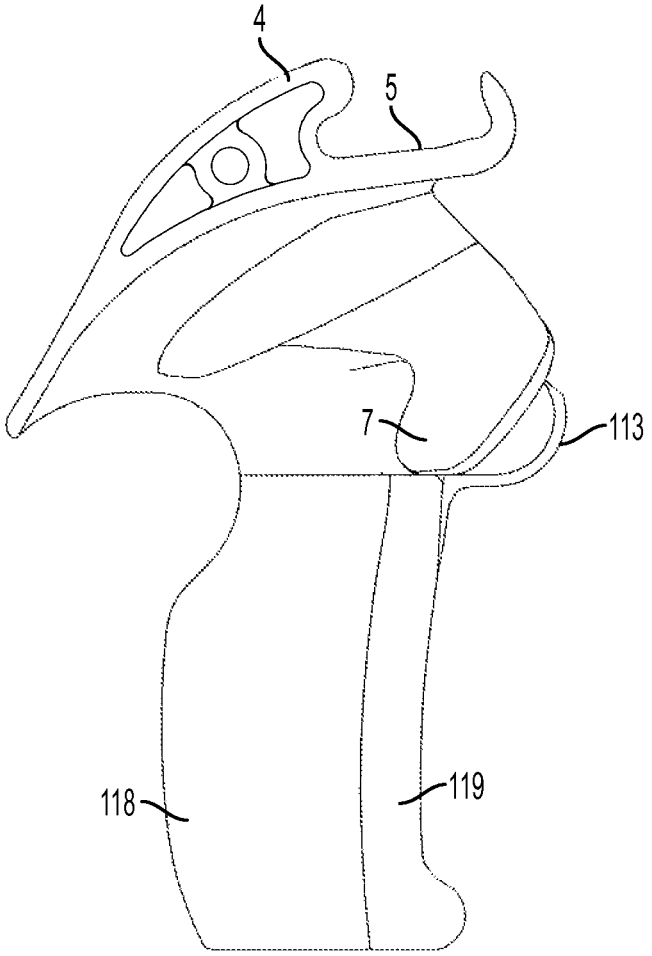
FIG. 30 is left side view of the handleless slingshot of FIG. 26.
Figure 31:
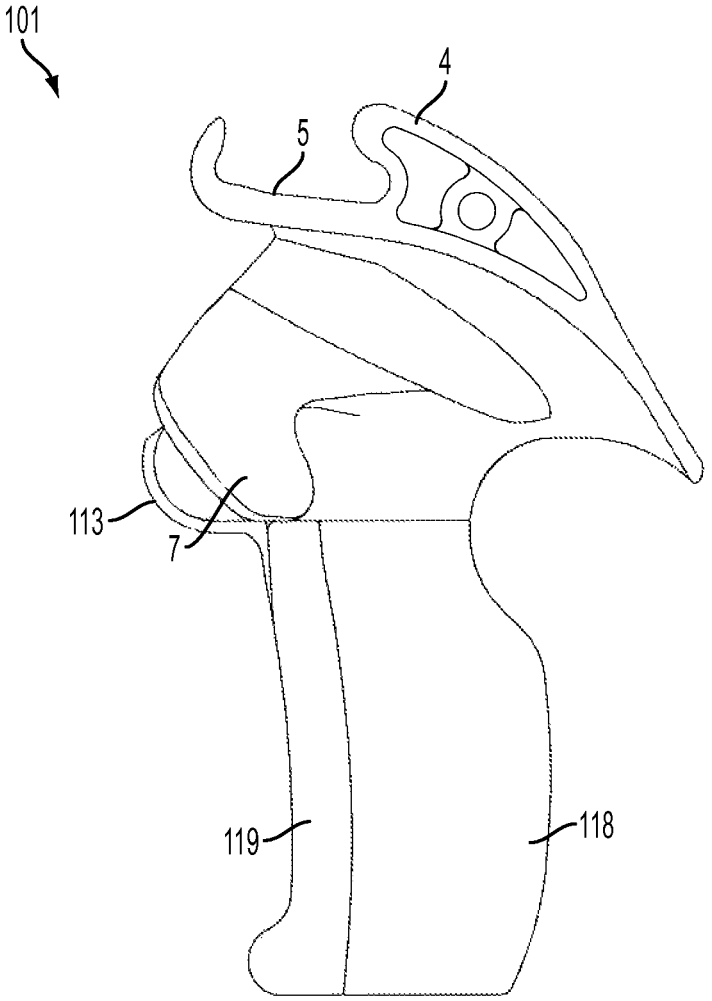
FIG. 31 is a right side view of the handleless slingshot of FIG. 26.
Figure 32:
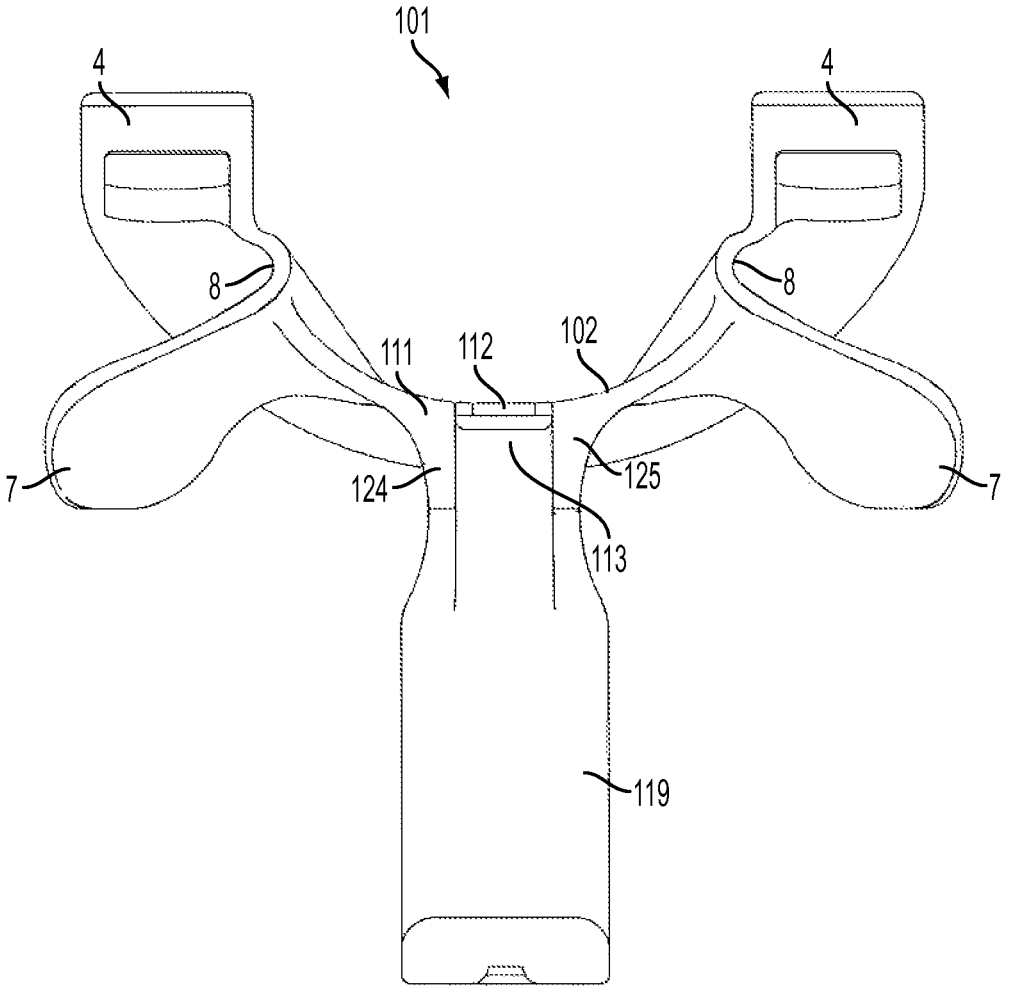
FIG. 32 is a front view of the handleless slingshot of FIG. 26.
Figure 33:
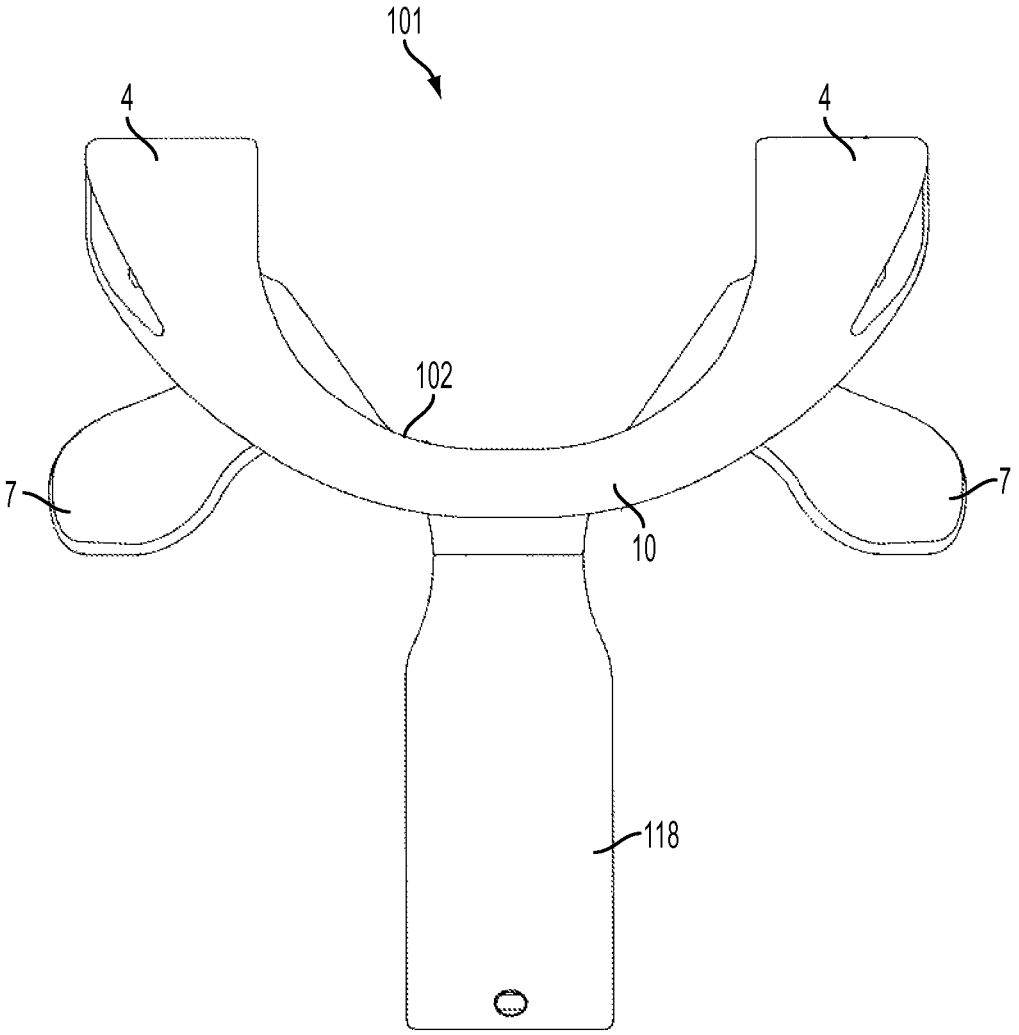
FIG. 33 is a rear view of the handleless slingshot of FIG. 26.

The storage compartment 118 and the storage compartment lid 119 are hingedly connected to the body hinge mechanism 111 of the body 102, at the storage compartment hinge mechanism 112 and the storage compartment lid hinge mechanism 113. In one embodiment, for example as shown in FIG. 26, the hinge body mechanism 111 includes a first ear 124 and a second ear 125 spaced from the first ear 124. The storage compartment hinge mechanism 112 and the storage compartment lid hinge mechanism 113 are positioned between the first ear 124 and the second ear 125.

The storage compartment lid hinge mechanism 113 includes a first leg 126 and a second leg 127 spaced from the first leg 126. The storage compartment hinge mechanism 112 is positioned between the first leg 126 and the second leg 127. The common axis extends through the first ear 124, the second ear 125, the first leg 126, the second leg 127 and the storage compartment hinge mechanism 112.

Figure 34:
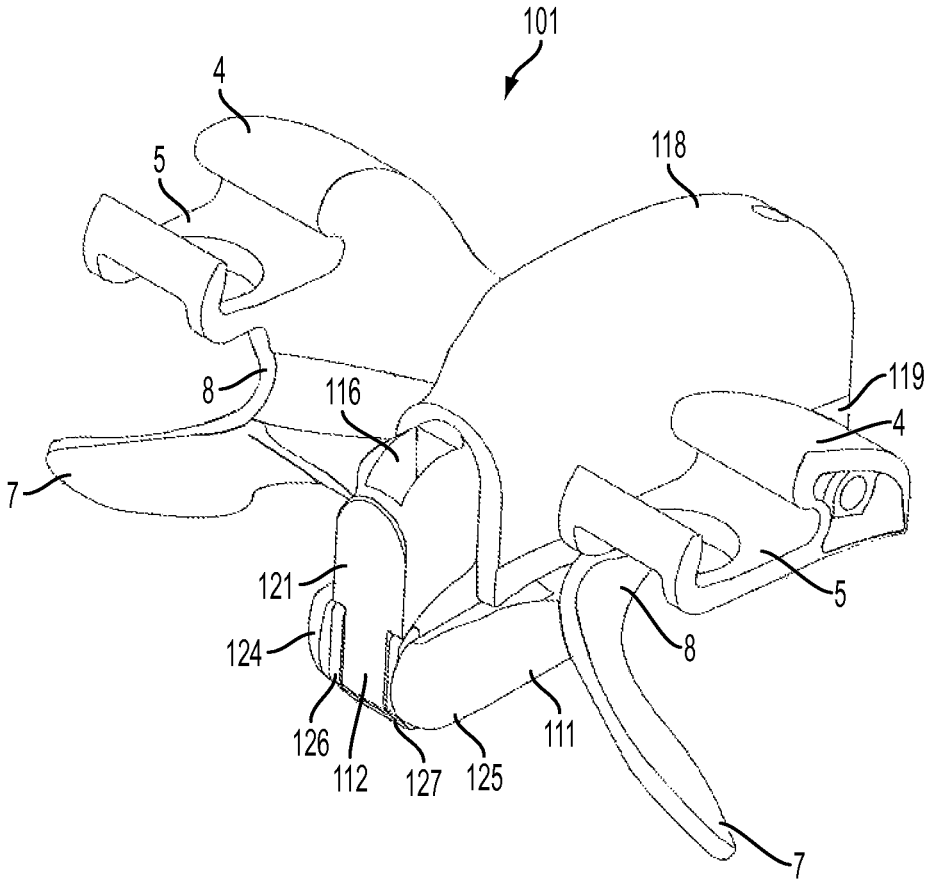
FIG. 34 is a front, top perspective view of the handleless slingshot of FIG. 26 with the folding storage compartment in a fully folded position.
Figure 35:
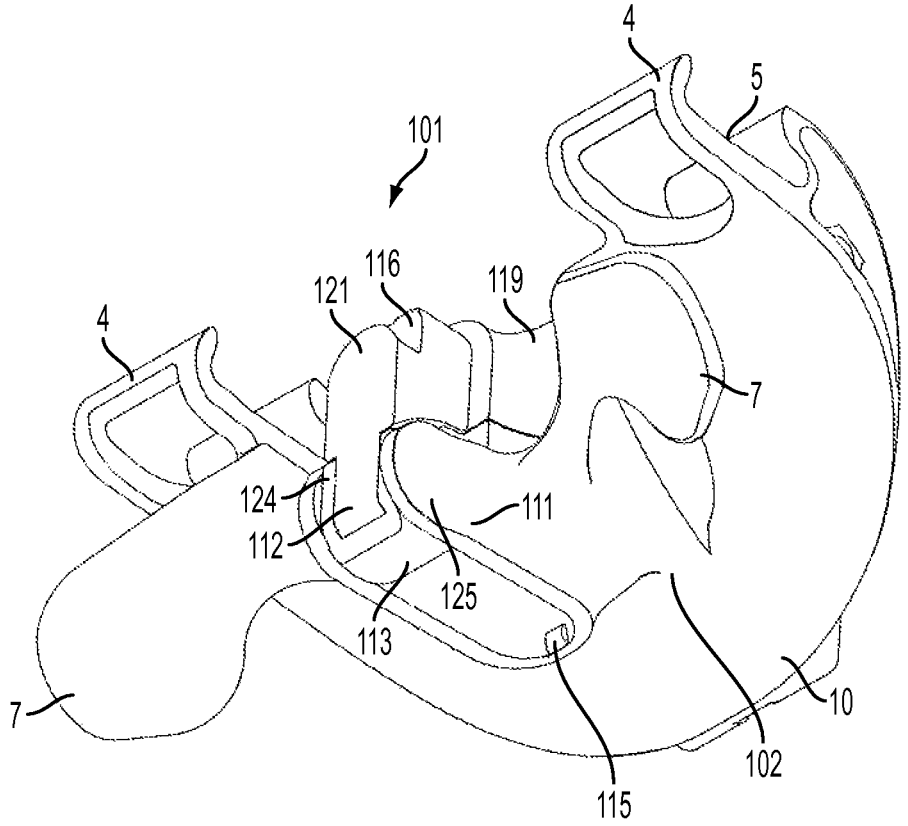
FIG. 35 is a front, bottom perspective view of the handleless slingshot of FIG. 34.
Figure 36:
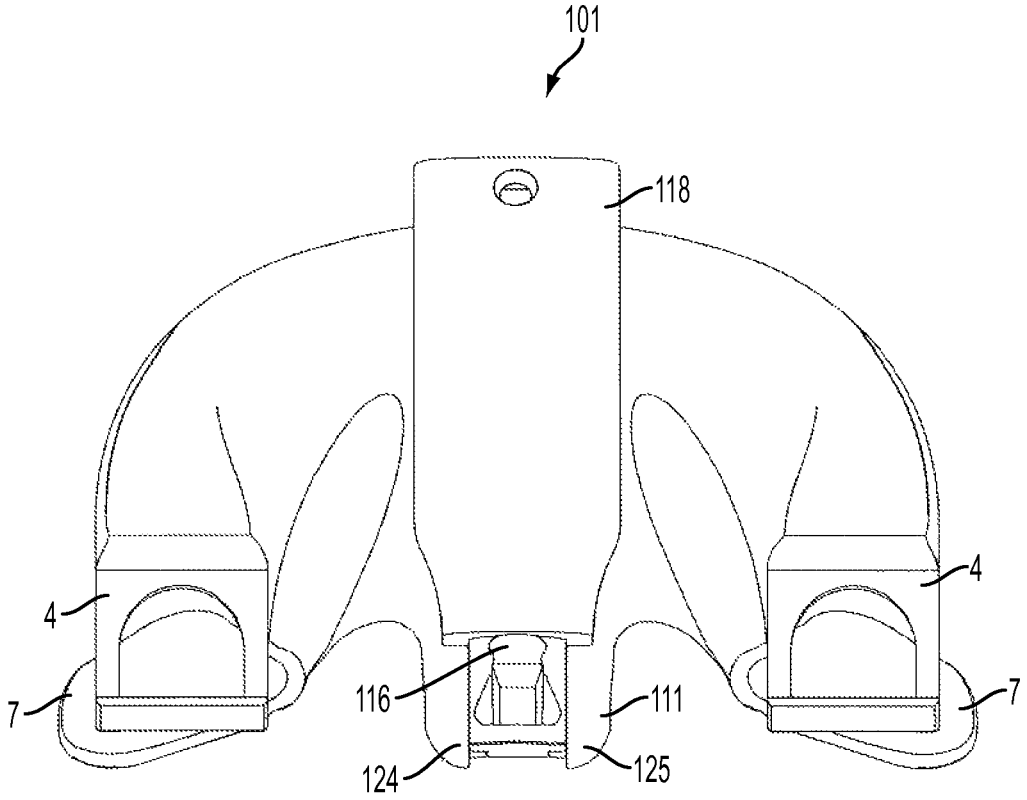
FIG. 36 is a top view of the handleless slingshot of FIG. 34.

Referring to FIGS. 34-41, to the handleless slingshot 101 is shown with the storage compartment 118 in the folded position. As shown in FIGS. 34 and 35, for example, the storage compartment 118 includes a mounting base 121. The storage compartment hinge mechanism 112 is formed at one end of the mounting base 121. A latching mechanism is formed at an opposite end of the mounting base 121 from the storage compartment hinge mechanism. The latching mechanism may be, for example, a latching opening 116 formed within the mounting base 121.

Figure 37:
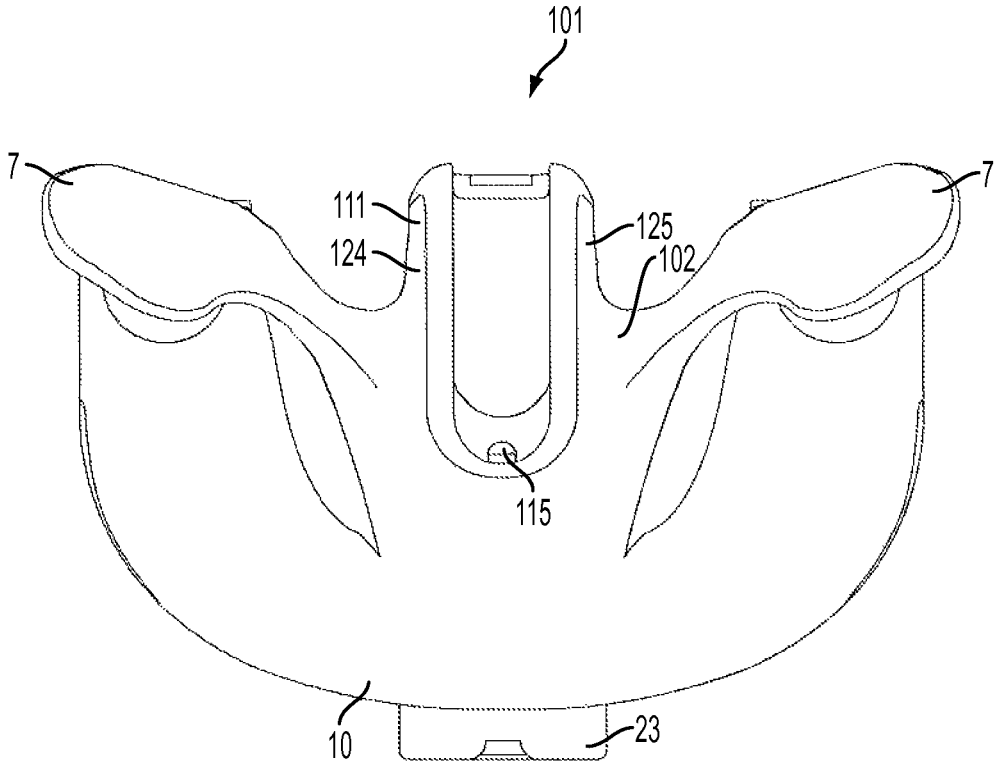
FIG. 37 is a bottom view of the handleless slingshot of FIG. 34.

As seen in FIGS. 35 and 37, for example, the body 102 includes a cooperating latching mechanism formed therein. The cooperating latching mechanism may be, for example, a latching tab 115 configured to releasably engage the latching opening to releasably secure or lock the storage compartment 118 in the open, unfolded position. The engagement between the latching tab 115 and the latching opening may be, for example, a friction fit or an interlocking fit.

Figure 38:
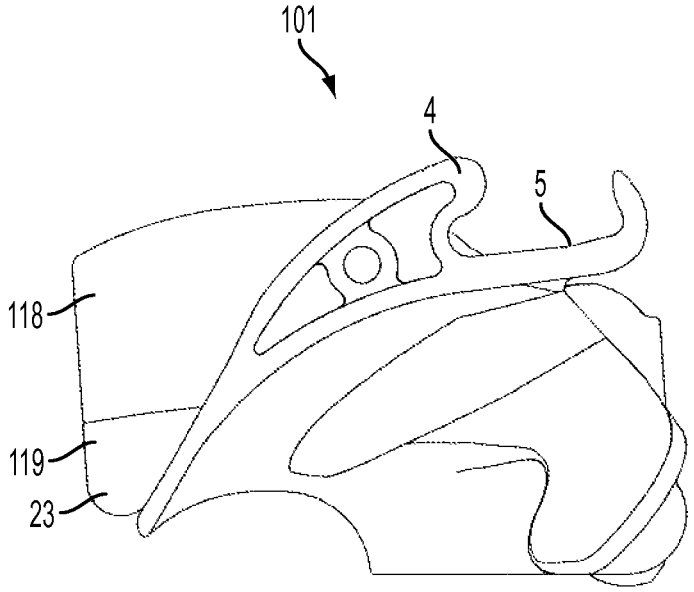
FIG. 38 is a left side view of the handleless slingshot of FIG. 34.
Figure 39:
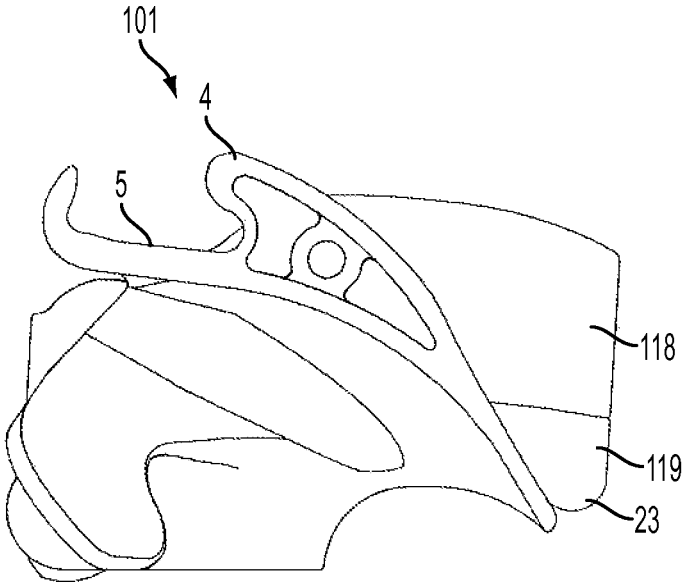
FIG. 39 is a right side view of the handleless slingshot of FIG. 34.
Figure 40:
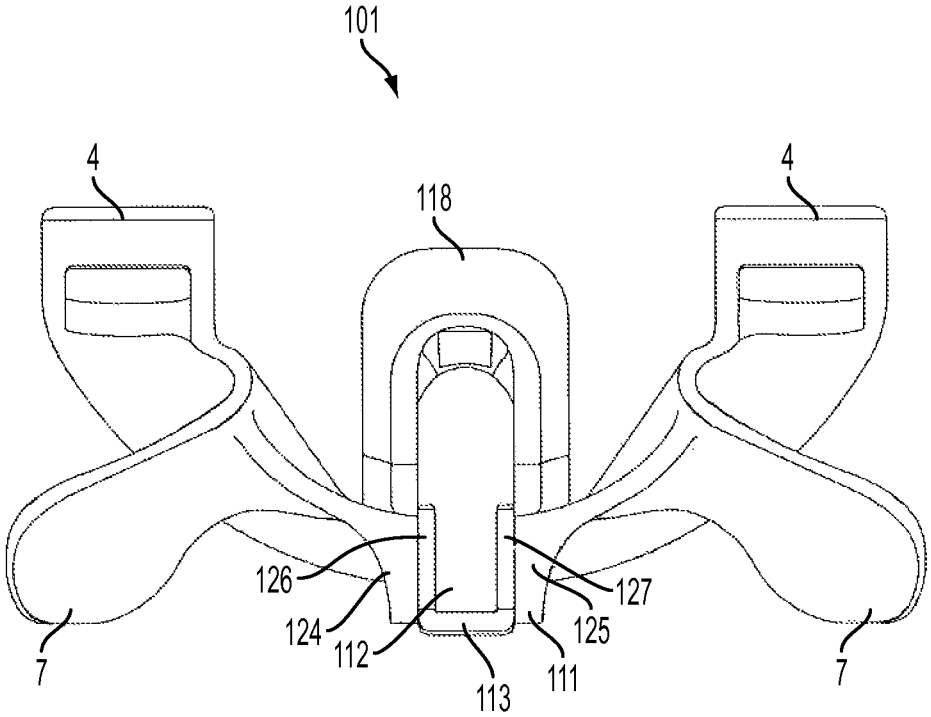
FIG. 40 is a front view of the handleless slingshot of FIG. 34.
Figure 41:
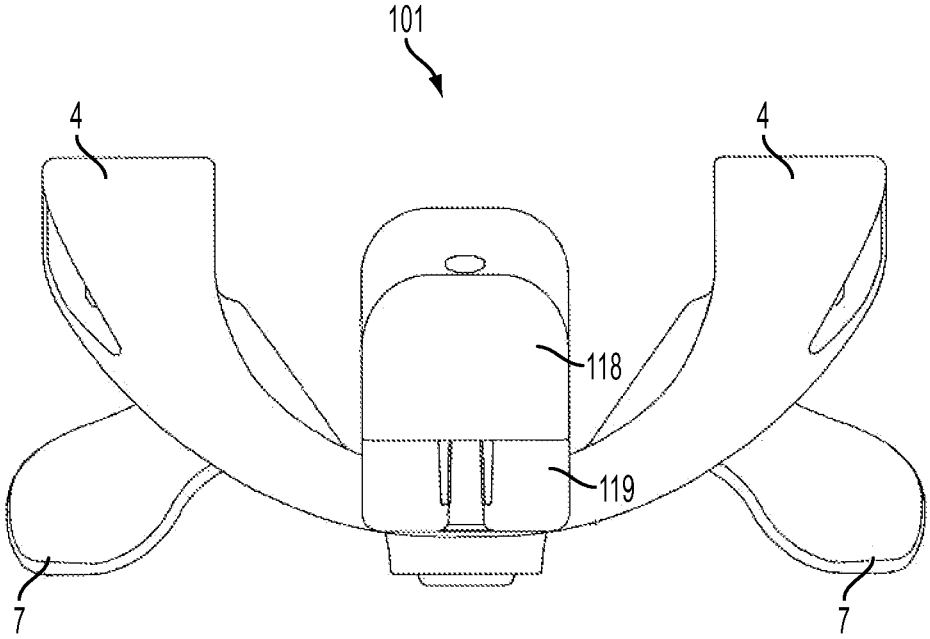
FIG. 41 is a rear view of the handleless slingshot of FIG. 34.

With the storage compartment lid 119 in the folded position, for example, as shown in FIGS. 38 and 39, the storage compartment lid 119 may mating engage the body 102. For example, the storage compartment lid 119 may have a contour corresponding to a contour of the body 102 of the handleless slingshot 101.

It is understood that the features described above may be used together with, implemented in and/or substituted for other various features of the examples described above. For example, the latching mechanisms and cooperating latching mechanisms described above may be implemented in either of the handleless slingshots 1, 101 shown in FIGS. 1-25 or FIGS. 26-41. Similarly, the hinge mechanisms of the body 2, 102, storage compartment 18, 118 and storage compartment lid 19, 119 may be used with the handleless slingshots 1, 101 shown in FIGS. 1-25 or FIGS. 26-41.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

All patents referred to herein, are hereby incorporated herein by reference, whether or not specifically done so within the text of this disclosure.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A handleless slingshot, the slingshot comprising:

a one piece body having a pair of integral arms, the body forming the slingshot, each arm configured to secure a band;

wherein each arm comprises a gripping portion for a user to grip while operating the slingshot, each gripping portion at least partially surrounding a thumb and an index finger, respectively, of the user when the user operates the slingshot, and each gripping portion having an elongated surface generally parallel to, and extending along a length of, the thumb and the index finger, respectively, of the user when the user operates the slingshot wherein a hand of the user only contacts the gripping portion of each arm when the user operates the slingshot.

2. The handleless slingshot of claim 1 wherein the gripping portion comprises a recess.

3. The handleless slingshot of claim 1 wherein the gripping portion further comprises an upper surface.

4. The handleless slingshot of claim 1 wherein the gripping portion further comprises a lower surface.

5. The handleless slingshot of claim 1 wherein the gripping portions of each of the arms each further comprise an upper surface and a lower surface.

6. The handleless slingshot of claim 1 wherein the gripping portions are angled inwardly toward the user when the user operates the slingshot.

7. The handleless slingshot of claim 1, wherein each arm is formed with a groove therein, the groove configured to receive a clip to secure the band.

8. The handleless slingshot of claim 1, wherein the slingshot engages multiple discrete contact points of a hand of the user to provide a counter-torque when the user operates the slingshot.

9. The handleless slingshot of claim 1, wherein the gripping portion is disposed at least partially forward of the band when the user operates the slingshot.

* * * * *